US009746223B2

(12) United States Patent
Yamashita

(10) Patent No.: US 9,746,223 B2
(45) Date of Patent: Aug. 29, 2017

(54) AIR-CONDITIONING APPARATUS

(75) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/818,149

(22) PCT Filed: Sep. 30, 2010

(86) PCT No.: PCT/JP2010/005889
§ 371 (c)(1),
(2), (4) Date: Feb. 21, 2013

(87) PCT Pub. No.: WO2012/042573
PCT Pub. Date: Apr. 5, 2012

(65) Prior Publication Data

US 2013/0152613 A1 Jun. 20, 2013

(51) Int. Cl.
*G01K 13/00* (2006.01)
*F25B 49/02* (2006.01)
(Continued)

(52) U.S. Cl.
CPC ..... *F25B 49/02* (2013.01); *F25B 9/006* (2013.01); *F25B 13/00* (2013.01); *F25B 25/005* (2013.01);
(Continued)

(58) Field of Classification Search
CPC ..... F25B 49/02; F25B 41/062; F25B 2600/2513; F25B 2700/00; F25B 2341/064; F25B 2700/2116; C09K 5/04
See application file for complete search history.

(56) References Cited

U.S. PATENT DOCUMENTS 4,766,735 A * 8/1988 Gotou ..... 62/175
4,987,747 A * 1/1991 Nakamura et al. ..... 62/160
(Continued)

FOREIGN PATENT DOCUMENTS

EP 0 750 166 A2 12/1996
JP 05-280818 A 10/1993
(Continued)

OTHER PUBLICATIONS

Daisuke et al., (JP2002333227A), Nov. 2002, English Translation; All Pages.*
(Continued)

*Primary Examiner* — Larry Furdge
(74) *Attorney, Agent, or Firm* — Posz Law Group, PLC

(57) ABSTRACT

An air-conditioning apparatus includes a high-pressure side pressure detection device detecting high-pressure side pressure, a low-pressure side pressure detection device detecting low-pressure side pressure, a high-low pressure bypass pipe connecting a pipe on a discharge side of a compressor and a pipe on a suction side of the compressor, a bypass expansion device disposed in the high-low pressure bypass pipe, a high-pressure side temperature detection device detecting high-pressure side temperature, and a low-pressure side temperature detection device detecting low-pressure side temperature; an outdoor unit side controller that detects circulation composition of refrigerant on the basis of the high-pressure side pressure, the low-pressure side pressure, the high-pressure side temperature, and the low-pressure side temperature; and a relay unit side controller performing at least one of a calculation of evaporating temperature and degree of superheat, and a calculation of condensing temperature and degree of subcooling on the basis of the circulation composition.

19 Claims, 11 Drawing Sheets

(51) Int. Cl.
*F25B 9/00* (2006.01)
*F25B 13/00* (2006.01)
*F25B 25/00* (2006.01)

(52) U.S. Cl.
CPC ..... *F25B 2313/0231* (2013.01); *F25B 2313/02732* (2013.01); *F25B 2313/02741* (2013.01); *F25B 2400/08* (2013.01); *F25B 2400/12* (2013.01)

(56) References Cited

U.S. PATENT DOCUMENTS

| | | | | | |
|---|---|---|---|---|---|
| 5,396,780 | A * | 3/1995 | Bendtsen | F25B | 41/062 236/75 |
| 5,709,094 | A * | 1/1998 | Ooyabu et al. | | 62/126 |
| 5,735,132 | A * | 4/1998 | Sumida et al. | | 62/129 |
| 5,987,907 | A * | 11/1999 | Morimoto et al. | | 62/212 |
| 6,073,459 | A * | 6/2000 | Iritani | B60H | 1/3205 62/204 |
| 7,415,838 | B2 * | 8/2008 | Park et al. | | 62/434 |
| 2008/0121837 | A1 * | 5/2008 | Singh et al. | | 252/67 |
| 2009/0151377 | A1 * | 6/2009 | Yonemori et al. | | 62/203 |
| 2010/0193156 | A1 * | 8/2010 | Nakatani et al. | | 165/63 |

FOREIGN PATENT DOCUMENTS

| | | | | |
|---|---|---|---|---|
| JP | 2001-289465 | A | | 10/2001 |
| JP | 2003-314914 | A | | 11/2003 |
| JP | 2003-343936 | A | | 12/2003 |
| JP | 2003343936 | A | * | 12/2003 |
| JP | 2004044948 | A | * | 2/2004 |
| JP | 2005-140444 | A | | 6/2005 |
| JP | WO2009133644 | A1 | * | 11/2009 |
| WO | 2009/154149 | A1 | | 12/2009 |
| WO | 2010/050003 | A1 | | 5/2010 |
| WO | 20101049998 | A1 | | 5/2010 |

OTHER PUBLICATIONS

Hidetochi, (JP2006029744A), Feb. 2004, English Translation; All Pages.*

NPL—www-old.me.gatech.edu-energy, Dec. 1997, p. 3.*

Takashi et al., Refrigeration Cycle System, Dec. 3, 2003, JP2003343936A, Whole Document.*

Shinichi et al., Air Conditioner, Nov. 5, 2009, WO2009133644A1, Whole Document.*

International Search Report of the International Searching Authority mailed Dec. 21, 2010 for the corresponding international application No. PCT/JP2010/005889 (with English translation).

Office Action mailed Jan. 21, 2014 issued in corresponding JP patent application No. 2012-536031 (and English translation).

European search report dated Mar. 18, 2014 issued in corresponding EP patent application No. 10857790.9.

Office Action issued on Sep. 15, 2014 for the corresponding CN patent application No. 201080069400.8 (with English translation).

* cited by examiner

AIR-CONDITIONING APPARATUS

CROSS REFERENCE TO RELATED APPLICATION

This application is a U.S. national stage application of PCT/JP2010/005889 filed on Sep. 30, 2010, the disclosure of which is incorporated herein by reference.

TECHNICAL FIELD

The present invention relates to an air-conditioning apparatus applicable to, for example, multi-air-conditioning apparatuses for office buildings, and the like.

BACKGROUND ART

A conventional air-conditioning apparatus, such as a multi-air-conditioning apparatus for office buildings, performs a cooling operation or a heating operation by, for example, circulating a refrigerant between an outdoor unit, which is a heat source unit disposed outdoors, and indoor units disposed indoors. Specifically, conditioned spaces are cooled with the air that has been cooled by the refrigerant removing heat from the air and is heated with the air that has been heated by the refrigerant transferring its heat. For example, HFC (hydrofluorocarbon)-based refrigerants are typically used as the refrigerant for such an air-conditioning apparatus. In some proposals, natural refrigerants such as carbon dioxide (CO2) are used.

Meanwhile, there is an air-conditioning apparatus having a different configuration represented by a chiller system. Such an air-conditioning apparatus performs cooling or heating as follows. Cooling energy or heating energy is generated in a heat source unit disposed outdoors. A heat medium such as water or antifreeze is heated or cooled by a heat exchanger disposed in the outdoor unit. The heat medium is conveyed to indoor units, such as fan coil units or panel heaters, disposed in space to be conditioned (see Patent Literature 1, for example).

Moreover, there is a heat source side heat exchanger called a heat recovery chiller that connects a heat source unit to each indoor unit with four water pipes arranged therebetween and supplies cooled and heated water or the like simultaneously so that cooling or heating can be freely selected in indoor units (see Patent Literature 2, for example).

In addition, there is another air-conditioning apparatus that disposes a heat exchanger for a primary refrigerant and a secondary refrigerant near each indoor unit and the secondary refrigerant is conveyed to the indoor unit (see Patent Literature 3, for example).

Furthermore, there is an air-conditioning apparatus that connects an outdoor unit to each branch unit including a heat exchanger with two pipes in which a secondary refrigerant is carried to the corresponding indoor unit (see Patent Literature 4, for example).

Moreover, air-conditioning apparatuses, such as a multi-air-conditioning apparatus for a building, include an air-conditioning apparatus in which a refrigerant is circulated from an outdoor unit to a relay unit and a heat medium, such as water, is circulated from the relay unit to each indoor unit to reduce conveyance power for the heat medium while circulating the heat medium, such as water, through the indoor unit (refer to Patent Literature 5, for example).

CITATION LIST

Patent Literature

Patent Literature 1: Japanese Unexamined Patent Application Publication No. 2005-140444 (Page. 4, FIG. 1, for example)

Patent Literature 2: Japanese Unexamined Patent Application Publication No. 5-280818 (Pages. 4 and 5, FIG. 1, for example)

Patent Literature 3: Japanese Unexamined Patent Application Publication No. 2001-289465 (Pages. 5 to 8, FIGS. 1, and. 2, for example)

Patent Literature 4: Japanese Unexamined Patent Application Publication No. 2003-343936 (Page. 5, FIG. 1)

Patent Literature 5: WO10/049,998 (Page 3, FIG. 1, for example)

SUMMARY

Technical Problem

Concerning each of the above air-conditioning apparatuses, there are some cases in which the refrigerant does not necessarily have to circulate through to the indoor units. Therefore, it is easy to employ a flammable refrigerant having a low global warming potential (GWP), considering the environment and so forth. Hence, developments of refrigerants, mixing of refrigerants, and the like have been attempted for an efficient operation, appropriation of existing devices, and so forth.

In a case where a plurality of refrigerants are mixed, however, the composition of the mixed refrigerant observed during the operation may become different from that observed at the time of injection of the mixed refrigerant because of different boiling points and so forth. Therefore, to control the operation with higher energy efficiency, it is necessary to grasp the composition during the circulation.

The invention is to solve the above problems and to provide an air-conditioning apparatus that is environmentally friendly and save energy by grasping the composition of refrigerants in circulation on the basis of presumption or the like.

Solution to Problem

An air-conditioning apparatus according to the invention includes a refrigeration cycle device having a refrigerant circuit in which a compressor that sends out a zeotropic refrigerant mixture containing tetrafluoropropene and R32, a refrigerant flow switching device for switching a passage through which the refrigerant circulates, a heat source side heat exchanger for exchanging heat of the refrigerant, a refrigerant expansion device for controlling pressure of the refrigerant, and a heat exchanger related to heat medium that is capable of exchanging heat between the refrigerant and a heat medium different from the refrigerant are connected by pipes in order to circulate the refrigerant. Further, the refrigeration cycle device includes a circulating refrigerant composition detection circuit having a low-pressure side pressure detection device for detecting low-pressure side pressure corresponding to pressure of the refrigerant suctioned by the compressor, a high-low pressure bypass pipe connecting a pipe on a discharge side of the compressor and a pipe on a suction side of the compressor, a bypass expansion device disposed in the high-low pressure bypass pipe, a high-pressure side temperature detection device for detecting high-pressure side temperature corresponding to temperature of the refrigerant flowing into the bypass expansion device, a low-pressure side temperature detection device for detecting low-pressure side temperature corresponding to temperature of the refrigerant discharged from the bypass expansion device, and a heat exchanger related to refrigerant that exchanges heat between the refrigerant flowing into the bypass expansion device and the refrigerant discharged from the bypass expansion device. This apparatus also includes a heat medium side device having a heat medium circulation circuit in which a heat medium sending device for circulating the heat medium for the heat exchange performed by the heat exchanger related to heat medium, a use side heat exchanger that exchanges heat between the heat medium and air in a space to be conditioned, and a heat medium flow switching device that switches a passage of the heat medium having flowed through the heat exchanger related to heat medium to the use side heat exchanger are connected by pipes. The apparatus further includes a first controller that detects the composition of circulating refrigerant in the refrigeration cycle device on the basis of at least the low-pressure side pressure, the high-pressure side temperature, and the low-pressure side temperature. Furthermore, the apparatus also includes a second controller disposed at a position away from the first controller and connecting to be capable of communicating to the first controller with wire or no wire. And the second controller performs, in a heat medium relay unit including the heat exchanger related to heat medium, at least one of a calculation of evaporating temperature of the heat exchanger related to heat medium that functions as an evaporator and degree of superheat on a refrigerant outlet side thereof and a calculation of condensing temperature of the heat exchanger related to heat medium that functions as a condenser and degree of subcooling on the refrigerant outlet side thereof, on the basis of the circulation composition received through the communication with the first controller. In the apparatus, at least the compressor, the refrigerant flow switching device, the heat source side heat exchanger, and the circulating refrigerant composition detection circuit are accommodated in an outdoor unit, and at least the heat exchanger related to heat medium and the refrigerant expansion device are accommodated in the heat medium relay unit. The outdoor unit and the heat medium relay unit are provided separately and are installable at separate positions to be away from each other. The first controller is disposed in or near the outdoor unit. The second controller is disposed in or near the heat medium relay unit.

Advantageous Effects of Invention

In the air-conditioning apparatus according to the invention, the composition of a refrigerant containing a plurality of components and circulating during the operation is detected on the basis of the pressures and the temperatures on the discharge side and the suction side of the compressor. Therefore, the evaporating temperature, the degree of superheat, the condensing temperature, and the degree of subcooling for the heat exchanger related to heat medium can be determined in accordance with the composition, whereby the refrigerant expansion device can be controlled. Hence, an air-conditioning apparatus having high energy efficiency is provided, and energy can be saved. Since the pipes through which the medium circulates can be made shorter than that of other air-conditioning apparatuses such as a chiller, conveyance power can be reduced and energy can be further saved. In addition, since the heat medium circulates through the indoor unit, even if, for example, the refrigerant leaks into the conditioned space, entry of the refrigerant into the room can be suppressed. Thus, a safe air-conditioning apparatus is provided.

DETAILED DESCRIPTION

Figure 1:
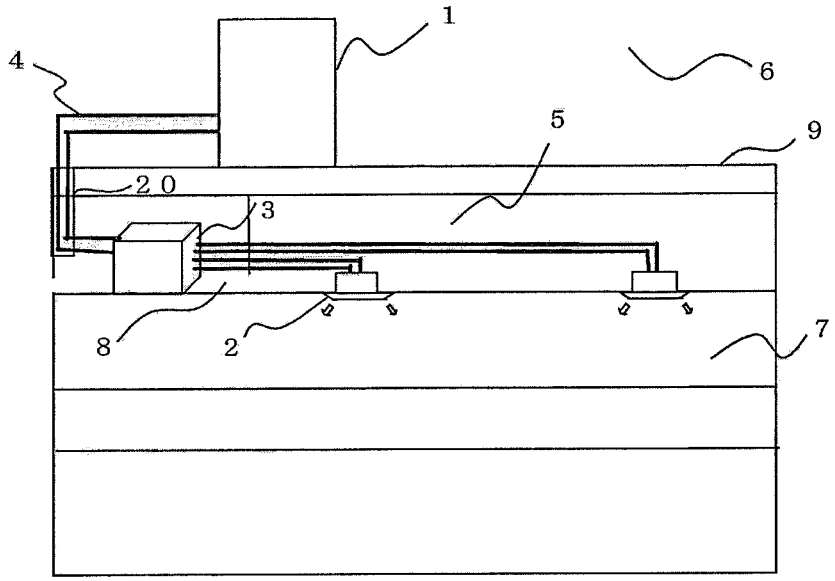
FIG. 1 is a system configuration diagram of an air-conditioning apparatus according to Embodiment of the invention.
Figure 2:
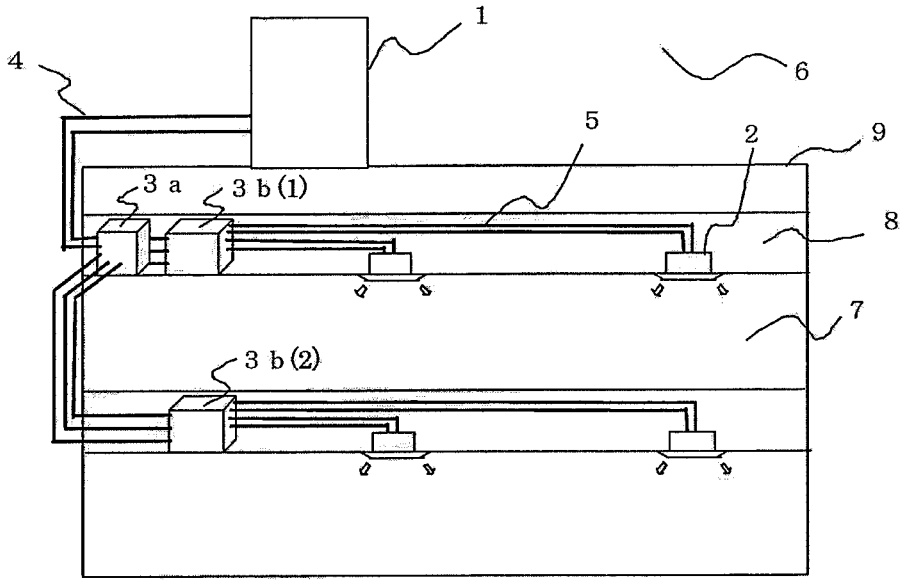
FIG. 2 is another system configuration diagram of the air-conditioning apparatus of Embodiment according to the invention.

Embodiment of the invention will be described with reference to the drawings. FIGS. 1 and 2 are schematic diagrams illustrating exemplary installations of the air-conditioning apparatus according to Embodiment of the invention. The exemplary installations of the air-conditioning apparatus will be described with reference to FIGS. 1 and 2. In the air-conditioning apparatus, each indoor unit can freely select an operation mode from a cooling mode and a heating mode with the use of devices including instruments and the like forming circuits (a refrigerant circuit (refrigeration cycle) A and a heat medium circuit B) through which a heat source side refrigerant (hereinafter referred to as refrigerant) and a heat medium are made to circulate, respectively. Note that the dimensional relationship among components in FIG. 1 and the other figures may be different from the actual one. Furthermore, concerning a plurality of devices and the like of the same kind that are distinguished with respective suffixes, if there is no need to distinguish or identify each of them, the suffixes may be omitted.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipes 4 through which the heat source side refrigerant flows. The heat medium relay unit 3 and each indoor unit 2 are connected with pipes 5 (heat medium pipes) through which the heat medium flows. Cooling energy or heating energy generated in the outdoor unit 1 is delivered through the heat medium relay unit 3 to the indoor units 2.

Referring to FIG. 2, the air-conditioning apparatus according to Embodiment includes the single outdoor unit 1, the plurality of indoor units 2, and a plurality of separated heat medium relay units 3 (a main heat medium relay unit 3*a* and sub heat medium relay units 3*b*) arranged between the outdoor unit 1 and the indoor units 2. The outdoor unit 1 and the main heat medium relay unit 3*a* are connected with the refrigerant pipes 4. The main heat medium relay unit 3*a* and the sub heat medium relay units 3*b* are connected with the refrigerant pipes 4. Each of the sub heat medium relay units 3*b* is connected to each indoor unit 2 by the pipes 5. Cooling energy or heating energy generated in the outdoor unit 1 is delivered through the main heat medium relay unit 3*a* and the sub heat medium relay units 3*b* to the indoor units 2.

The outdoor unit 1 is typically disposed in an outdoor space 6 which is a space (e.g., a roof) outside of a structure 9, such as an office building, and is configured to supply cooling energy or heating energy through the heat medium relay unit 3 to the indoor units 2. Each indoor unit 2 is disposed at a position that can supply cooling air or heating air to an indoor space 7, which is an indoor space (e.g., a living room) inside of the structure 9, and supplies cooling air or heating air to the indoor space 7 as a space to be conditioned. The heat medium relay unit 3 is configured with a housing separate from the outdoor unit 1 and the indoor units 2 such that the heat medium relay unit 3 can be disposed at a position different from those of the outdoor space 6 and the indoor space 7, that is, at an unconditioned space, and is connected to the outdoor unit 1 through the refrigerant pipes 4 and is connected to the indoor units 2 through the pipes 5 to convey cooling energy or heating energy, supplied from the outdoor unit 1 to the indoor units 2.

As illustrated in FIGS. 1 and 2, in the air-conditioning apparatus according to Embodiment, the outdoor unit 1 is connected to the heat medium relay unit 3 using two refrigerant pipes 4, and the heat medium relay unit 3 is connected to each indoor unit 2 using a pair of pipes 5. As described above, in the air-conditioning apparatus according to Embodiment, each of the units (the outdoor unit 1, the indoor units 2, and the heat medium relay unit 3) is connected using two pipes (the refrigerant pipes 4 or the pipes 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) branched off from the main heat medium relay unit 3*a*. This separation allows the plurality of sub heat medium relay units 3*b* to be connected to the single main heat medium relay unit 3*a*. In this configuration, the main heat medium relay unit 3*a* is connected to each sub heat medium relay unit 3*b* by three refrigerant pipes 4. Such a circuit will be described in detail later (refer to FIG. 3A).

Furthermore, FIGS. 1 and 2 illustrate a state where each heat medium relay unit 3 is disposed in the structure 9 but in a space different from the indoor space 7, for example, an unconditioned space such as a space above a ceiling (hereinafter, simply referred to as a "space 8"). The heat medium relay unit 3 can be disposed in other spaces, such as a common space where an elevator or the like is installed. Furthermore, although FIGS. 1 and 2 illustrate a case where the indoor units 2 are of a ceiling cassette type, the indoor units are not limited to this type and may be of any type, such as a ceiling concealed type or a ceiling suspended type, as long as the indoor units 2 are capable of blowing out heating air or cooling air into the indoor space 7 directly or through a duct or the like.

Although FIGS. 1 and 2 illustrate the case in which the outdoor unit 1 is disposed in the outdoor space 6, the arrangement is not limited to this case. For example, the outdoor unit 1 may be disposed in an enclosed space, for example, a machine room with a ventilation opening, may be disposed inside of the structure 9 as long as waste heat can be exhausted through an exhaust duct to the outside of the structure 9, or may be disposed inside of the structure 9 in the use of the outdoor unit 1 of a water-cooled type. There is no particular problem when the outdoor unit 1 is disposed in such a place.

Furthermore, the heat medium relay unit 3 can be disposed near the outdoor unit 1. If the distance between the heat medium relay unit 3 and each indoor unit 2 is too long, the conveyance power for the heat medium becomes considerably large. It should be therefore noted that the energy saving effect is reduced in this case. Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to Embodiment is installed.

Figure 3:
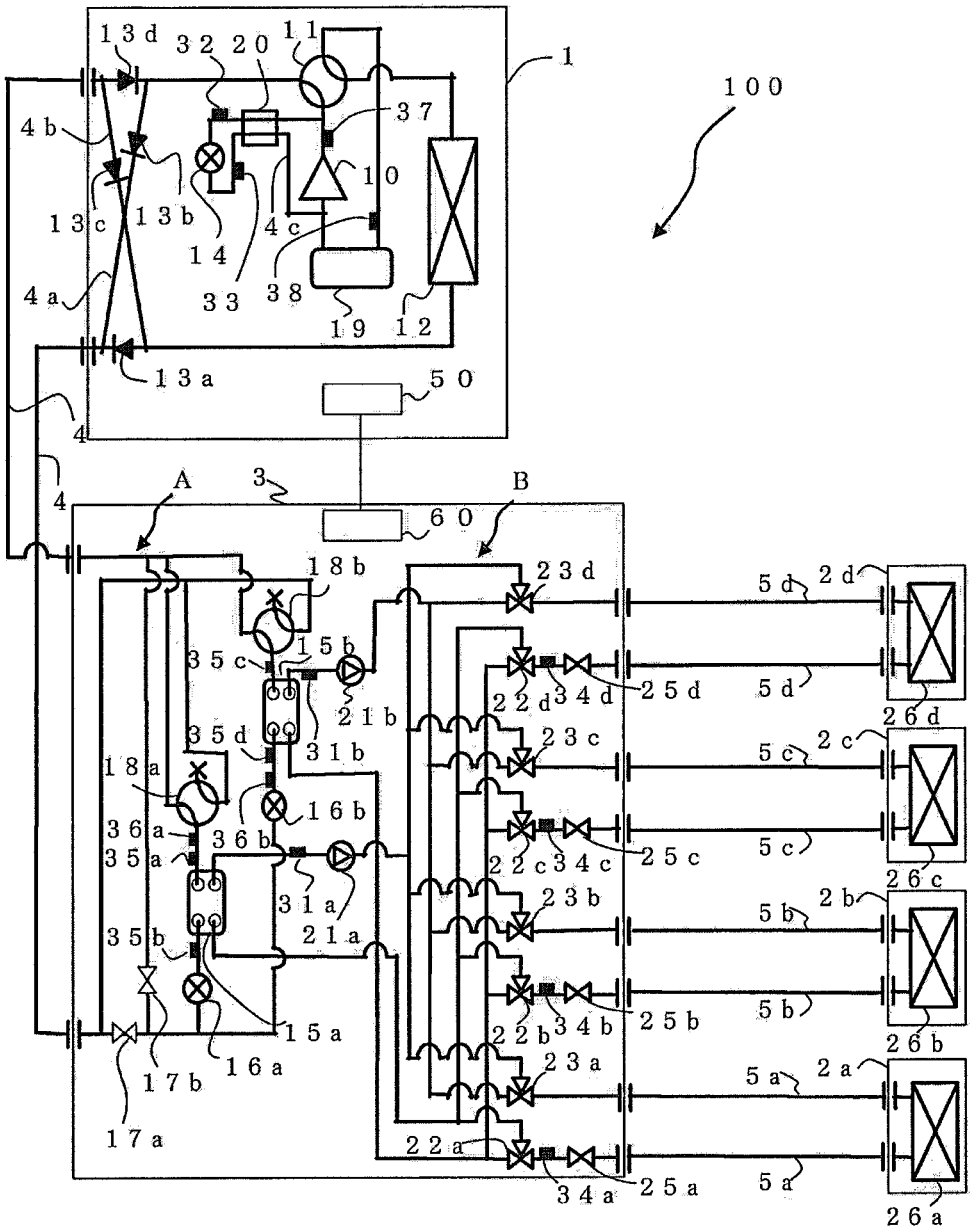
FIG. 3 is a system circuit diagram of the air-conditioning apparatus according to Embodiment of the invention.

FIG. 3 is a schematic configuration diagram illustrating an exemplary circuit configuration of the air-conditioning apparatus (hereinafter, referred to as an "air-conditioning apparatus 100") according to Embodiment. The detailed configuration of the air-conditioning apparatus 100 will be described with reference to FIG. 3. As illustrated in FIG. 3, the outdoor unit 1 and the heat medium relay unit 3 are connected with the refrigerant pipes 4 through heat exchangers 15*a* and 15*b* related to heat medium included in the heat medium relay unit 3. Furthermore, the heat medium relay unit 3 and the indoor units 2 are connected with the pipes 5 (a pipe 5*a* to a pipe 5*d*) through the heat exchangers 15*a* and 15*b* related to heat medium. Note that the refrigerant pipes 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19, which are connected in series by the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. Such an arrangement of the first connecting pipe 4*a*, the second connecting pipe 4*b*, the check valve 13*a*, the check valve 13*b*, the check valve 13*c*, and the check valve 13*d* enables the heat source side refrigerant, allowed to flow into the heat medium relay unit 3, to flow in a constant direction irrespective of an operation requested by any indoor unit 2. An outdoor unit side controller 50, corresponding to a first controller, controls devices included in the outdoor unit 1. For example, the outdoor unit side controller 50 controls the driving frequency of the compressor 10, the switching of the first refrigerant flow switching device 11, the rotation speed (including ON/OFF) of an air-sending device (not illustrated) that sends air toward the heat source side heat exchanger 12, and so forth. The outdoor unit side controller 50 also controls operations and the like concerning the entirety of the air-conditioning apparatus 100 in cooperation with a relay unit side controller 60 corresponding to a second controller, and so forth by transmitting and receiving signals through wired, radio, or any other type of communication. Particularly, in Embodiment, the outdoor unit side controller 50 performs a detection process in which the composition of the refrigerant circulating through the refrigerant circuit A is presumed and detected.

The outdoor unit 1 according to Embodiment further includes a high-low pressure bypass pipe 4*c* that connects passages on the discharge side and the suction side of the compressor 10, thereby forming a circulation composition detection circuit. A bypass expansion device 14 disposed in the high-low pressure bypass pipe 4*c* controls the flow rate and the pressure of the refrigerant flowing through the high-low pressure bypass pipe 4*c*. The bypass expansion device 14 may be an electronic expansion valve capable of changing its opening degree, or a capillary tube or the like whose amount of expansion is fixed. A heat exchanger 20 related to refrigerant exchanges heat between refrigerants obtained before and after the passage through the bypass expansion device 14. The heat exchanger 20 related to refrigerant according to Embodiment is, for example, a double-pipe heat exchanger but is not limited thereto. The heat exchanger 20 related to refrigerant may alternatively be a plate heat exchanger, a microchannel heat exchanger, or the like that is capable of exchanging heat between a refrigerant on the high-pressure side and a refrigerant on the low-pressure side.

A high-pressure side refrigerant temperature detection device 32 and a low-pressure side refrigerant temperature detection device 33 are temperature sensors of, for example, a thermistor type or the like. The high-pressure side refrigerant temperature detection device 32 is disposed on the inlet side (refrigerant inlet side) of the bypass expansion device 14 and detects a refrigerant temperature TH on the high-pressure side of the refrigerant circuit A. The low-pressure side refrigerant temperature detection device 33 is disposed on the outlet side (refrigerant outlet side) of the bypass expansion device 14 and detects a refrigerant temperature TL on the low-pressure side of the refrigerant circuit A. A high-pressure side pressure detection device 37 and a low-pressure side pressure detection device 38 are pressure sensors of, for example, a strain-gauge type, a semiconductor type, or the like. The high-pressure side pressure detection device 37 detects pressure PH on the high-pressure side (pressure on the discharge side) of the compressor 1 (refrigerant circuit A). The low-pressure side pressure detection device 38 detects pressure PL on the low-pressure side (pressure on the suction side) of the compressor 1. In FIG. 3, the low-pressure side pressure detection device 38 is provided in a passage disposed between the accumulator 19 and the first refrigerant flow switching device 11, but the position thereof is not limited thereto. For example, the low-pressure side pressure detection device 38 may be provided at any position such as a position in a passage disposed between the compressor 10 and the accumulator 19, as long as the low-pressure side pressure detection device 38 can detect the pressure on the low-pressure side of the compressor 10. The high-pressure side pressure detection device 37 may also be provided at any position, as long as the high-pressure side pressure detection device 37 can measure the pressure on the high-pressure side of the compressor 10.

The compressor 10 is configured to suction the heat source side refrigerant and compress the heat source side refrigerant to a high-temperature, high-pressure state, and may be a capacity-controllable inverter compressor, for example. The first refrigerant flow switching device 11 switches the flow of the heat source side refrigerant between a heating operation (a heating only operation mode and a heating main operation mode) and a cooling operation (a cooling only operation mode and a cooling main operation mode). The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporates and gasifies or condenses and liquefies the heat source side refrigerant. The accumulator 19 is provided on the suction side of the compressor 10 and retains excess refrigerant.

The check valve 13*d* is disposed in the refrigerant pipe 4 positioned between the heat medium relay unit 3 and the first refrigerant flow switching device 11 and is configured to permit the heat source side refrigerant to flow only in a predetermined direction (the direction from the heat medium relay unit 3 to the outdoor unit 1). The check valve 13*a* is disposed in the refrigerant pipe 4 positioned between the heat source side heat exchanger 12 and the heat medium relay unit 3 and is configured to permit the heat source side refrigerant to flow only in a predetermined direction (the direction from the outdoor unit 1 to the heat medium relay unit 3). The check valve 13*b* is disposed in the first connecting pipe 4*a* and is configured to allow the heat source side refrigerant, discharged from the compressor 10 in the heating operation, to flow to the heat medium relay unit 3. The check valve 13*c* is disposed in the second connecting pipe 4*b* and is configured to allow the heat source side refrigerant, returned from the heat medium relay unit 3 in the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1. It should be noted that FIG. 3 illustrates a case in which the first connecting pipe 4*a*, the second connecting pipe 4*b*, the check valve 13*a*, the check valve 13*b*, the check valve 13*c*, and the check valve 13*d* are provided, but the devices is not limited to this case, and they may be omitted.

In Embodiment, a mixed refrigerant containing tetrafluoropropene, such as HFO-1234yf or HFO-1234ze expressed by the chemical formula C3H2F4, and difluoromethane (R32) expressed by the chemical formula CH2F2 is injected into the refrigerant pipes, and the mixed refrigerant circulates through the refrigerant pipes.

Tetrafluoropropene, which has a double bond in its chemical formula, is easy to be decomposed in the atmosphere and has a low GWP (4 to 6). That is, tetrafluoropropene is, for example, an environmentally friendly refrigerant. However, tetrafluoropropene has lower density than a conventional refrigerant such as R410A. Therefore, to obtain a large heating capacity or a large cooling capacity by using tetrafluoropropene alone as the refrigerant, a very large compressor is required. Moreover, to prevent the increase in pressure loss that may occur in pipes, refrigerant pipes having large diameters are also required. Consequently, the air-conditioning apparatus costs high.

On the other hand, R32 has characteristics similar to those of, for example, conventional refrigerants such as R410A. Therefore, fewer changes in the apparatus are required. That is, R32 is a refrigerant that is relatively easy to use. However, the GWP of R32 is 675, which is smaller than 2088 of R410A or the like but is considered to be relatively large from the environmental point of view.

Hence, a mixed refrigerant containing tetrafluoropropene and R32 is used. Such a mixed refrigerant contributes to a reduction in GWP and improvements in refrigerant characteristics, whereby an earth-friendly, efficient air-conditioning apparatus is obtained. The mixing ratio of tetrafluoropropene to R32 is not limited to and may be, for example, 70 to 30 or the like in percentage by mass.

Figure 4:
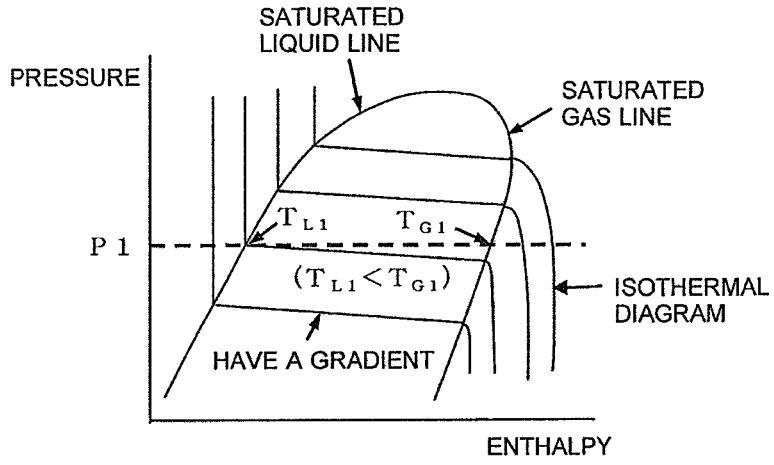
FIG. 4 is an exemplary p-h diagram of the air-conditioning apparatus according to Embodiment.

FIG. 4 is a p-h diagram of the mixed refrigerant according to Embodiment 1. In the mixed refrigerant used in Embodiment, HFO-1234yf has a boiling point of −29° C. and R32 has a boiling point of −53.2° C. That is, the mixed refrigerant is a zeotropic refrigerant mixture whose components have different dew points and different boiling points. Since, for example, there are liquid reservoirs such as the accumulator 19 in the refrigerant circuit A, the mixed refrigerant containing a plurality of components and circulating through the circuit exhibits a variable composition during the circulation (hereinafter referred to as circulation composition) that is not fixed by the mixing ratio. Moreover, since the components of a zeotropic refrigerant mixture have different boiling points, the saturated liquid temperature and the saturated gas temperature are different at the same pressure. For example, as illustrated in FIG. 4, a saturated liquid temperature TL1 and a saturated gas temperature TG1 at a pressure P1 are not equal, specifically; the saturated gas temperature TG1 is higher than the saturated liquid temperature TL1. Therefore, isothermal lines in the two-phase region of the p-h diagram are tilted (have a gradient).

When the composition of the mixed refrigerant changes, the p-h diagram changes and the gradient of the isothermal lines also changes. For example, in a case where the ratio of HFO-1234yf to R32 in percentage by mass is 70 to 30, the gradient angle is 5.0° C. on the high-pressure side and 7° C. on the low-pressure side, approximately. In a case where the ratio is 50 to 50, the gradient angle is 2.3° C. on the high-pressure side and 2.8° C. on the low-pressure side, approximately. Therefore, to accurately calculate the saturated liquid temperature and the saturated gas temperature at a pressure in the refrigerant circuit A, the circulation composition of the refrigerant in the refrigerant circuit A needs to be detected.

Hence, the air-conditioning apparatus according to Embodiment includes a circulation composition detection circuit in which the high-low pressure bypass pipe 4*c* is provided with the bypass expansion device 14 and the heat exchanger 20 related to refrigerant. Thus, the circulation composition of the refrigerant in the refrigerant circuit A is detected on the basis of the temperatures detected by the high-pressure side refrigerant temperature detection device 32 and the low-pressure side refrigerant temperature detection device 33 and the pressures detected by the high-pressure side pressure detection device 37 and the low-pressure side pressure detection device 38. That is, the circulation composition is detected by a refrigerant circuit as the circulation composition detection circuit not including devices such as the accumulator 19 and in which the passage from the compressor 10 is short. Thus, accurate detection can be performed.

Figure 5:
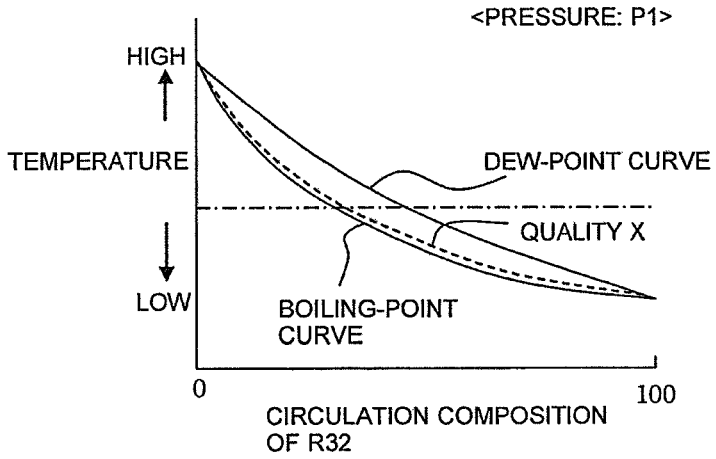
FIG. 5 is a diagram for describing circulation composition detection performed by the air-conditioning apparatus according to Embodiment.

FIG. 5 is a vapor-liquid equilibrium diagram of a two-component mixed refrigerant at the pressure P1. The two solid lines illustrated in FIG. 5 represent a dew-point curve, which is a saturated gas line obtained when a gas refrigerant is condensed and liquefied, and a boiling-point curve, which is a saturated liquid line obtained when a liquid refrigerant is evaporated and gasified, respectively.

Figure 6:
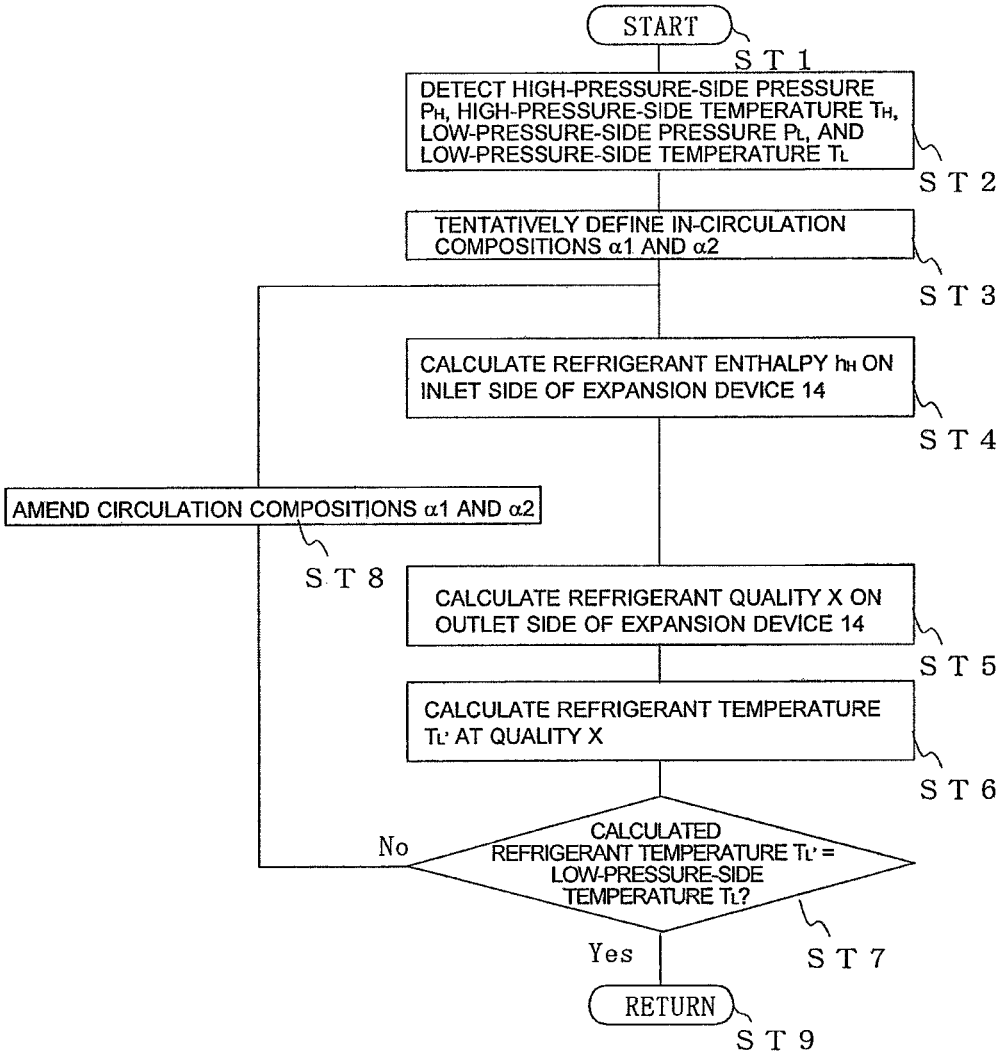
FIG. 6 is a diagram illustrating a flowchart for a process of circulation composition detection performed by the air-conditioning apparatus according to Embodiment.

FIG. 6 is a diagram illustrating a flowchart for a process of detecting circulation composition. Referring to FIG. 6, a procedure will be described in accordance with which the outdoor unit side controller 50 detects the composition of the refrigerant that is circulating through the refrigerant circuit A. Herein, the detection of the circulation composition of a mixed refrigerant containing two components will be described.

The outdoor unit side controller 50 starts the process (ST1). The pressure (high-pressure side pressure) PH detected by the high-pressure side pressure detection device 37, the temperature (high-pressure side temperature) TH detected by the high-pressure side refrigerant temperature detection device 32, the pressure (low-pressure side pressure) PL detected by the low-pressure side pressure detection device 38, and the temperature (low-pressure side temperature) TL detected by the low-pressure side refrigerant temperature detection device 33 are measured (ST2). Further, the circulation compositions of the two components contained in the mixed refrigerant that is circulating through the refrigerant circuit A are assumed to be $\alpha 1$ and $\alpha 2$, (ST3). Here, the initial values of $\alpha 1$ and $\alpha 2$ are not especially limited to and may be, for example, based on the mixing ratio obtained at the time of injection of the refrigerant, for example, 0.7 for $\alpha 1$ and 0.3 for $\alpha 2$.

Figure 7:
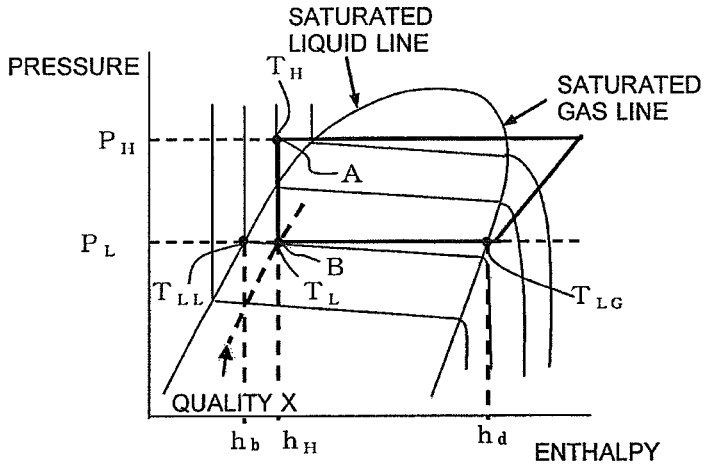
FIG. 7 is another exemplary p-h diagram of the air-conditioning apparatus according to Embodiment.

FIG. 7 is a p-h diagram illustrating the high-pressure side pressure PH, the high-pressure side temperature TH, the low-pressure side pressure PL, and the low-pressure side temperature TL. Once the components of the refrigerant are determined, the enthalpy of the refrigerant can be calculated from the pressure and the temperature of the refrigerant. Hence, an enthalpy hH of the refrigerant on the inlet side of the bypass expansion device 14 is calculated from the high-pressure side pressure PH and the high-pressure side temperature TH (ST4) (point A in FIG. 7).

When the refrigerant flows through the bypass expansion device 14 and is thus expanded, the enthalpy of the refrigerant does not change. Therefore, a quality X of the two-phase refrigerant on the outlet side of the bypass expansion device 14 is calculated from the low-pressure side pressure PL and the enthalpy hH and in accordance with Expression (1) given below (ST5) (point B in FIG. 7). In Expression (1), hb denotes the saturated liquid enthalpy at the low-pressure side pressure PL, and hd denotes the saturated gas enthalpy at the low-pressure side pressure PL.

$$X=(hH-hb)/(hd-hb) \tag{1}$$

Then, a temperature TL' of the refrigerant at the quality X is calculated from a saturated gas temperature TLG and a saturated liquid temperature TLL at the low-pressure side pressure PL and in accordance with Expression (2) given below (ST6).

$$TL'=TLL\times(1-X)+TLG\times X \tag{2}$$

It is determined whether or not TL' thus calculated is regarded as being equal to the detected temperature TL (ST7). If not equal, the assumed circulation compositions $\alpha 1$ and α2 of the two components of the refrigerant are amended (ST8) and the process is repeated from step ST4. If it is determined that TL' and TL are regarded as being substantially equal, it is regarded that the circulation compositions have been identified and the process ends (ST9). Through such a process, the circulation composition of a two-component zeotropic refrigerant mixture can be detected.

Now, a method of amending α1 and α2 will be described specifically. For example, it is assumed that a mixed refrigerant containing HFO-1234yf and R-32 is used as the refrigerant, and the composition ratio (mixing ratio) of HFO-1234yf and the composition ratio of R-32 as the initial compositions at the time of injection are 0.7 (70%) and 0.3 (30%), respectively, which are taken as the initial values for α and α2, respectively. It is also assumed that, at point B in a certain state during the operation, the low-pressure side pressure PL is 0.6 MPa, the quality X is 0.2, and the low-pressure side temperature TL measured is 0° C.

When the pressure is 0.6 MPa, the saturated liquid temperature and the saturated gas temperature observed when α1 is 0.8 and α2 is 0.2 are −0.4° C. and 8.5° C., respectively. Further, the saturated liquid temperature and the saturated gas temperature observed when α1 is 0.7 and α2 is 0.3 are −3.3° C. and 3.6° C., respectively. Furthermore, the saturated liquid temperature and the saturated gas temperature observed when α1 is 0.6 and α2 is 0.4 are −5.1° C. and −0.5° C., respectively. The outdoor unit side controller 50 stores data on such relationships of α1 and α2 with respect to the saturated liquid temperature and the saturated gas temperature in the form of functions, tables, and the like in a storage device (not illustrated), and uses the data in performing the above process.

On the basis of the above conditions, the temperature TL' calculated in accordance with Expression (2) is 6.7° C. when α1 is 0.8 and α2 is 0.2, 2.2° C. when α1 is 0.7 and α2 is 0.3, and −1.4 when α1 is 0.6 and α2 is 0.4.

On the other hand, the measured low-pressure side temperature TL is 0° C. Hence, α1 is supposed to be between 0.7 and 0.6, and α2 is supposed to be between 0.3 and 0.4. Therefore, α1 is amended to be reduced while α2 is amended to be increased. Then, the circulation composition of the mixed refrigerant with which the measured temperature TL and the calculated temperature TL' match is obtained.

While the detection of circulation composition of a two-component mixed refrigerant containing tetrafluoropropene expressed by the chemical formula C3H2F4 and difluoromethane (R32) expressed by the chemical formula CH2F2 has been described, the invention is not limited to this case. A zeotropic refrigerant mixture containing other two components is also acceptable. Moreover, any kind of tetrafluoropropene such as HFO-1234yf, HFO-1234ze, or the like may be used.

Alternatively, a three-component mixed refrigerant containing, for example, another additional component is also acceptable. For example, even in a case of a three-component zeotropic refrigerant mixture, there is a correlation in terms of ratio between two of the components. Hence, if the circulation composition of a pair of two components is assumed to be α1, for example, the circulation composition of the remaining component can be assumed to be α2. Therefore, the circulation composition of the three-component mixed refrigerant can be obtained through the substantially same process as that for the detection of the circulation composition of a two-component refrigerant.

Thus, the circulation composition of a mixed refrigerant can be detected. Furthermore, if a certain pressure is detected, saturated liquid temperature and saturated gas temperature at that pressure can be arithmetically calculated. For example, if the mean temperature (simple average temperature) of the saturated liquid temperature and the saturated gas temperature is determined as the saturation temperature at that pressure, the saturation temperature can be used in, for example, controlling the compressor 10 and a refrigerant expansion device 16. As another alternative, since the heat transfer coefficient of the refrigerant varies with the quality of the refrigerant, weighted mean temperature obtained by weighing the saturated liquid temperature and the saturated gas temperature may be taken as the saturation temperature. An operation of controlling the refrigerant expansion device 16 will be described separately below.

On the low-pressure side (evaporation side), if the temperature of a two-phase refrigerant at the inlet of the evaporator is measured and the result is assumed to be the saturated liquid temperature or the temperature of the two-phase refrigerant at a preset quality, factors such as pressure and saturated gas temperature can be obtained, even without measuring the pressure, by calculating backward in accordance with the relative expression for calculating saturated liquid temperature and saturated gas temperature from circulation composition and pressure. Therefore, the low-pressure side pressure detection device is not essential. Nevertheless, it is necessary to assume the point where the temperature has been measured as being the saturated liquid temperature or to set the quality. Therefore, saturated liquid temperature and saturated gas temperature can be obtained more accurately by using any pressure detection device.

There is a mixed refrigerant having such characteristics that, on the high-pressure side (condensation side), isothermal lines in the subcooled-liquid zone extend substantially vertically and the temperature does not change with the pressure as illustrated in FIG. 7. For example, a mixed refrigerant containing HFO-1234yf (tetrafluoropropene) and R32 has the above characteristics. Hence, for some mixed refrigerants, the enthalpy hH can be determined by liquid temperature alone even without the high-pressure side pressure detection device 37. That is, the high-pressure side pressure detection device 37 is not an essential detection device.

[Indoor Units 2]

The indoor units 2 each include a use side heat exchanger 26. Each of the use side heat exchangers 26 is connected by the pipes 5 to a heat medium flow control device 25 and a second heat medium flow switching device 23 arranged in the heat medium relay unit 3. The use side heat exchanger 26 is configured to exchange heat between air supplied from an air-sending device, such as a fan (not illustrated), and the heat medium in order to generate heating air or cooling air to be supplied to the indoor space 7.

FIG. 4 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as a use side heat exchanger 26*a*, a use side heat exchanger 26*b*, a use side heat exchanger 26*c*, and a use side heat exchanger 26*d* in that order from the bottom of the drawing sheet so as to correspond to the indoor units 2*a* to 2*d*, respectively. Note that as is the case of FIGS. 1 and 2, the number of connected indoor units 2 illustrated in FIG. 4 is not limited to four.

[Heat Medium Relay Unit 3]

The heat medium relay unit 3 includes the two heat exchangers 15 related to heat medium, two refrigerant expansion devices 16, two opening and closing devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 3A. The relay unit side controller 60, corresponding to the second controller, controls devices included in the heat medium relay unit 3. For example, the relay unit side controller 60 controls the opening degrees of the refrigerant expansion devices 16, the opening and closing of the opening and closing devices 17, the switching of the second refrigerant flow switching devices 18, the first heat medium flow switching devices 22, and the second heat medium flow switching devices 23, and so forth in the refrigerant circuit A. Furthermore, the relay unit side controller 60 controls the driving of the pumps 21, the opening degrees of the heat medium flow control devices 25, and so forth in the heat medium circuit B. Particularly, in Embodiment, the relay unit side controller 60 calculates, for example, the evaporating temperatures, the degree of superheat, the condensing temperatures, and the degree of subcooling for the heat exchangers 15 related to heat medium, thereby controlling the opening degrees of the refrigerant expansion devices 16 and other operations.

Each of the two heat exchangers 15 related to heat medium (the heat exchanger 15*a* related to heat medium and the heat exchanger 15*b* related to heat medium) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchanger 15*a* related to heat medium is disposed between a refrigerant expansion device 16*a* and a second refrigerant flow switching device 18*a* in the refrigerant circuit A and is used to heat cool the heat medium in the cooling and heating mixed operation mode. Additionally, the heat exchanger 15*b* related to heat medium is disposed between a refrigerant expansion device 16*b* and a second refrigerant flow switching device 18*b* in the refrigerant circuit A and is used to heat the heat medium in the cooling and heating mixed operation mode. In this case, two heat exchangers 15 related to heat medium are provided. Alternatively, one heat exchanger 15 related to heat medium or three or more heat exchangers 15 related to heat medium may be provided.

The two refrigerant expansion devices 16 (the refrigerant expansion device 16*a* and the refrigerant expansion device 16*b*) each have functions of a reducing valve and an expansion valve and are configured to reduce the pressure of the heat source side refrigerant in order to expand it. The refrigerant expansion device 16*a* is disposed upstream from the heat exchanger 15*a* related to heat medium in the flow direction of the heat source side refrigerant during the cooling operation. The refrigerant expansion device 16*b* is disposed upstream from the heat exchanger 15*b* related to heat medium in the flow direction of the heat source side refrigerant during the cooling operation. Each of the two refrigerant expansion devices 16 may include a component having a variably controllable opening degree, such as an electronic expansion valve.

The two opening and closing devices 17 (an opening and closing device 17*a* and an opening and closing device 17*b*) each include a two-way valve and the like, and are configured to open or close the refrigerant pipe 4. The opening and closing device 17*a* is disposed in the refrigerant pipe 4 on the inlet side of the heat source side refrigerant. The opening and closing device 17*b* is disposed in a pipe connecting the refrigerant pipe 4 on the inlet side for the heat source side refrigerant and the refrigerant pipe 4 on an outlet side therefor. The two second refrigerant flow switching devices 18 (the second refrigerant flow switching devices 18*a* and 18*b*) each include, for example, a four-way valve and switch passages of the heat source side refrigerant in accordance with the operation mode. The second refrigerant flow switching device 18*a* is disposed downstream from the heat exchanger 15*a* related to heat medium in the flow direction of the heat source side refrigerant during the cooling operation. The second refrigerant flow switching device 18*b* is disposed downstream from the heat exchanger 15*b* related to heat medium in the flow direction of the heat source side refrigerant during the cooling only operation.

The two pumps 21 (a pump 21*a* and a pump 21*b*) are configured to circulate the heat medium conveyed through the pipes 5. The pump 21*a* is disposed in the pipe 5 positioned between heat exchanger 15*a* related to heat medium and the second heat medium flow switching devices 23. The pump 21*b* is disposed in the pipe 5 between the heat exchanger 15*b* related to heat medium and the second heat medium flow switching devices 23. Each of the two pumps 21 may include, for example, a capacity-controllable pump.

The four first heat medium flow switching devices 22 (first heat medium flow switching devices 22*a* to 22*d*) each include, for example, a three-way valve and switches passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding heat medium flow control device 25. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) each include, for example, a three-way valve and the like, are configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger 15*a* related to heat medium, another one of the three ways is connected to the heat exchanger 15*b* related to heat medium, and the other one of the three ways is connected to the corresponding use side heat exchanger 26. Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

The four heat medium flow control devices 25 (heat medium flow control devices 25*a* to 25*d*) each include, for example, a two-way valve capable of controlling the area of opening and controls the flow rate of the flow in each pipe 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

The heat medium relay unit 3 further includes various detection devices (two heat medium discharge temperature detection devices 31, four heat medium outlet temperature detection devices 34, four refrigerant inlet/outlet temperature detection devices 35, and two refrigerant pressure detection devices 36). Signals related to detection by these detection devices are transmitted to, for example, the outdoor unit side controller 50 and are used in controlling the driving frequency of the compressor 10, the rotation speed of the air-sending device (not illustrated), the switching of the first refrigerant flow switching device 11, the driving frequency of the pumps 21, the switching of the second refrigerant flow switching devices 18, the switching of the heat medium passages, and so forth.

The two heat medium discharge temperature detection devices 31 (a heat medium discharge temperature detection device 31*a* and a heat medium discharge temperature detection device 31*b*) each detect the temperature of the heat medium discharged from a corresponding one of the heat exchangers 15 related to heat medium, or the heat medium at the outlet of the heat exchanger 15 related to heat medium, and may be, for example, thermistors or the like. The heat medium discharge temperature detection device 31*a* is disposed in the pipe 5 on the inlet side of the pump 21*a*. The heat medium discharge temperature detection device 31*b* is disposed in the pipe 5 on the inlet side of the pump 21*b*.

The four heat medium outlet temperature detection devices 34 (a heat medium outlet temperature detection device 34*a* to a heat medium outlet temperature detection device 34*d*) are each disposed between the corresponding first heat medium flow switching device 22 and the corresponding heat medium flow control device 25, and each detect the temperature of the heat medium discharged from the corresponding use side heat exchanger 26. The heat medium outlet temperature detection devices 34 may be thermistors or the like. The heat medium outlet temperature detection devices 34 are arranged so that the number thereof (four in this case) corresponds to the installed number of indoor units 2. Furthermore, illustrated from the bottom of the drawing are the heat medium outlet temperature detection device 34*a*, the heat medium outlet temperature detection device 34*b*, the heat medium outlet temperature detection device 34*c*, and the heat medium outlet temperature detection device 34*d* so as to correspond to the respective indoor units 2.

The four refrigerant inlet/outlet temperature detection devices 35 (a refrigerant inlet/outlet temperature detection device 35*a* to a refrigerant inlet/outlet temperature detection device 35*d*) are each disposed on the inlet side or the outlet side of the heat source side refrigerant of the corresponding heat exchanger 15 related to heat medium, and each detect the temperature of the heat source side refrigerant flowing into the heat exchanger 15 related to heat medium or the temperature of the heat source side refrigerant discharged from the heat exchanger 15 related to heat medium. The refrigerant inlet/outlet temperature detection devices 35 may be thermistors or the like. The refrigerant inlet/outlet temperature detection device 35*a* is disposed between the heat exchanger 15*a* related to heat medium and the second refrigerant flow switching device 18*a*. The refrigerant inlet/outlet temperature detection device 35*b* is disposed between the heat exchanger 15*a* related to heat medium and the refrigerant expansion device 16*a*. The refrigerant inlet/outlet temperature detection device 35*c* is disposed between the heat exchanger 15*b* related to heat medium and the second refrigerant flow switching device 18*b*. The refrigerant inlet/outlet temperature detection device 35*d* is disposed between the heat exchanger 15*b* related to heat medium and the refrigerant expansion device 16*b*. The refrigerant inlet/outlet temperature detection devices 35*a* and 35*c* each function as a first refrigerant inlet/outlet temperature detection device that detects the temperature of the refrigerant on the inlet side of the corresponding heat exchanger 15 related to heat medium functioning as a condenser. The refrigerant inlet/outlet temperature detection devices 35*b* and 35*d* each function as a second refrigerant inlet/outlet temperature detection device that detects the temperature of the refrigerant on the outlet side of the corresponding heat exchanger 15 related to heat medium functioning as a condenser.

A refrigerant pressure detection device (pressure sensor) 36*b* functioning as a first refrigerant pressure detection device is disposed between the heat exchanger 15*b* related to heat medium and the refrigerant expansion device 16*b*, similar to the installation position of the refrigerant inlet/outlet temperature detection device 35*d*, and is configured to detect the pressure of the heat source side refrigerant flowing between the heat exchanger 15*b* related to heat medium and the refrigerant expansion device 16*b*. A refrigerant pressure detection device 36*a* functioning as a second refrigerant pressure detection device is disposed between the heat exchanger 15*a* related to heat medium and the second refrigerant flow switching device 18*a*, similar to the installation position of the refrigerant inlet/outlet temperature detection device 35*a*, and is configured to detect the pressure of the heat source side refrigerant flowing between the heat exchanger 15*a* related to heat medium and second refrigerant flow switching device 18*a*. While two devices are provided in this case, one of the refrigerant pressure detection devices 36*a* and 36*b* may not necessarily be required depending on the situation as will be described later.

The pipes 5 for conveying the heat medium include the pipe connected to the heat exchanger 15*a* related to heat medium and the pipe connected to the heat exchanger 15*b* related to heat medium. Each pipe 5 is branched into the pipes 5*a* to 5*d* (four in this case) in accordance with the number of indoor units 2 connected to the heat medium relay unit 3. The pipes 5 are connected by the first heat medium flow switching devices 22 and the second heat medium flow switching devices 23. Controlling each first heat medium flow switching device 22 and each second heat medium flow switching device 23 determines whether the heat medium flowing from the heat exchanger 15*a* related to heat medium is allowed to flow into the corresponding use side heat exchanger 26 and whether the heat medium flowing from the heat exchanger 15*b* related to heat medium is allowed to flow into the corresponding use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, a refrigerant passage of the heat exchanger 15*a* related to heat medium, the refrigerant expansion devices 16, and the accumulator 19 are connected through the refrigerant pipe 4, thus forming the refrigerant circuit A. In addition, heat medium passages of the heat exchanger 15*a* related to heat medium, the pumps 21, the first heat medium flow switching devices 22, the heat medium flow control devices 25, the use side heat exchangers 26, and the second heat medium flow switching devices 23 are connected by the pipes 5, thus forming the heat medium circuits B. In other words, the plurality of use side heat exchangers 26 are connected in parallel to each of the heat exchangers 15 related to heat medium, thus turning the heat medium circuit B into a multi-system.

Accordingly, in the air-conditioning apparatus 100, the outdoor unit 1 and the heat medium relay unit 3 are connected through the heat exchanger 15*a* related to heat medium and the heat exchanger 15*b* related to heat medium arranged in the heat medium relay unit 3. The heat medium relay unit 3 and each indoor unit 2 are also connected through the heat exchanger 15*a* related to heat medium and the heat exchanger 15*b* related to heat medium. In other words, in the air-conditioning apparatus 100, the heat exchanger 15*a* related to heat medium and the heat exchanger 15*b* related to heat medium each exchange heat between the heat source side refrigerant circulating in the refrigerant circuit A and the heat medium circulating in the heat medium circuit B.

Figure 3A:
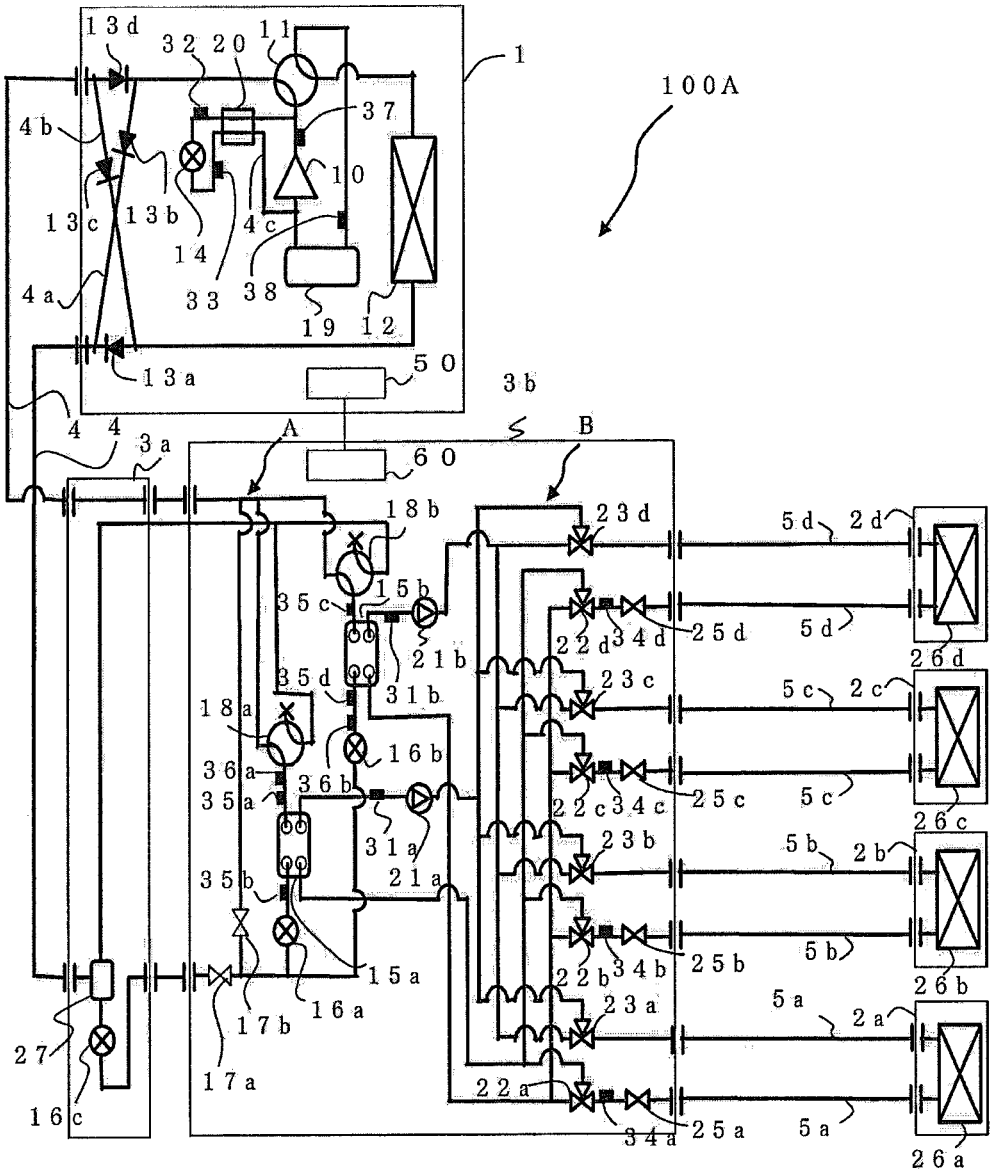
FIG. 3A is another system circuit diagram of the air-conditioning apparatus according to Embodiment of the invention.

FIG. 3A is another schematic circuit diagram illustrating an exemplary circuit configuration of the air-conditioning apparatus (hereinafter, referred to as an "air-conditioning apparatus 100A") according to Embodiment of the invention. The circuit configuration of the air-conditioning apparatus 100A in a case in which a heat medium relay unit 3 is separated into a main heat medium relay unit 3*a* and a sub heat medium relay unit 3*b* will be described with reference to FIG. 3A. As illustrate in FIG. 4A, the heat medium relay unit 3 includes the main heat medium relay unit 3*a* and the sub heat medium relay unit 3*b* that are provided in separate housings. This separation allows a plurality of sub heat medium relay units 3*b* to be connected to the single main heat medium relay unit 3*a* as illustrated in FIG. 2.

The main heat medium relay unit 3*a* includes a gas-liquid separator 27 and a refrigerant expansion device 16*c*. Other components are arranged in the sub heat medium relay unit 3*b*. The gas-liquid separator 27 is connected to a single refrigerant pipe 4 connected to the outdoor unit 1 and is connected to two refrigerant pipes 4 connected to the heat exchanger 15*a* related to heat medium and the heat exchanger 15*b* related to heat medium in the sub heat medium relay unit 3*b*, and is configured to separate the heat source side refrigerant supplied from the outdoor unit 1 into a vapor refrigerant and a liquid refrigerant. The refrigerant expansion device 16*c*, disposed downstream regarding the flow direction of the liquid refrigerant flowing out of the gas-liquid separator 27, has functions as a reducing valve and an expansion valve and decompresses and expands the heat source side refrigerant. During a cooling and heating mixed operation, the refrigerant expansion device 16*c* is controlled such that the pressure state of the refrigerant on an outlet side of the refrigerant expansion device 16*c* is medium pressure. The refrigerant expansion device 16*c* may include a component whose opening degree is variably controllable, such as an electronic expansion valve. This arrangement allows a plurality of sub heat medium relay units 3*b* to be connected to the main heat medium relay unit 3*a*.

Various operation modes carried out by the air-conditioning apparatus 100 will be described below. The air-conditioning apparatus 100 allows each indoor unit 2, on the basis of an instruction from the indoor unit 2, to perform a cooling operation or heating operation. Specifically, the air-conditioning apparatus 100 may allow all of the indoor units 2 to perform the same operation and also allow each of the indoor units 2 to perform different operations. It should be noted that since the same applies to operation modes carried out by the air-conditioning apparatus 100A, the description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 includes a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. The operation modes will be described below with respect to the flow of the heat source side refrigerant and that of the heat medium.

[Cooling Only Operation Mode]

Figure 8:
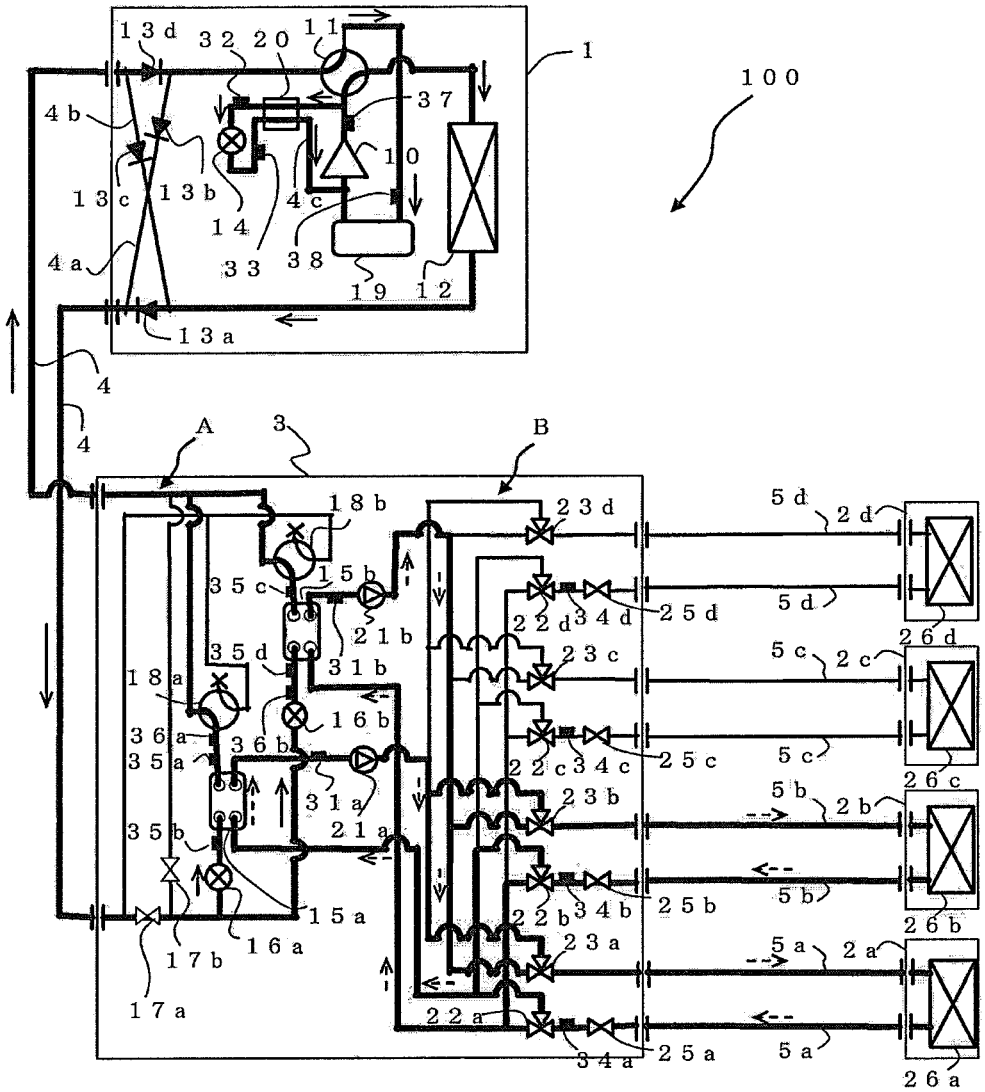
FIG. 8 is a system circuit diagram of the air-conditioning apparatus according to Embodiment during cooling only operation.

FIG. 8 is a refrigerant circuit diagram illustrating the flows of the refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 8. Furthermore, in FIG. 8, pipes indicated by thick lines correspond to pipes through which the refrigerants (the heat source side refrigerant and the heat medium) flow. Furthermore, in FIG. 8, solid-line arrows indicate the flow direction of the heat source side refrigerant and broken-line arrows indicate the flow direction of the heat medium.

In the cooling only operation mode illustrated in FIG. 8, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the heat exchanger 15*b* related to heat medium, and each of the use side heat exchanger 26*a* and the use side heat exchanger 26*b*.

First, the flow of the heat source side refrigerant in the refrigerant circuit A will be described.

A low-temperature, low-pressure refrigerant is compressed by the compressor 10 and is discharged as a high-temperature high-pressure gas refrigerant therefrom. The high-temperature, high-pressure gas refrigerant discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant pipe 4, and flows into the heat medium relay unit 3. The high-pressure liquid refrigerant, which has flowed into the heat medium relay unit 3, passes through the opening and closing device 17*a* and is then divided into flows to the refrigerant expansion device 16*a* and the refrigerant expansion device 16*b*, in each of which the refrigerant is expanded into a low-temperature, low-pressure two-phase refrigerant.

This two-phase refrigerant flows into each of the heat exchanger 15*a* related to heat medium and the heat exchanger 15*b* related to heat medium functioning as an evaporator, removes heat from the heat medium circulating in the heat medium circuit B to cool the heat medium, and turns into a low-temperature, low-pressure gas refrigerant. The gas refrigerant, which has flowed out of each of the heat exchanger 15*a* related to heat medium and the heat exchanger 15*b* related to heat medium, flows out of the heat medium relay unit 3 through the second refrigerant flow switching device 18*a* and the second refrigerant flow switching device 18*b*, respectively, passes through the refrigerant pipe 4, and again flows into the outdoor unit 1. The refrigerant which has flowed into the outdoor unit 1 passes through the check valve 13*d*, the first refrigerant flow switching device 11, and the accumulator 19, and is again suctioned into the compressor 10.

The outdoor unit side controller 50 performs the above-described process of detecting circulation composition during the operation. It may be processed regularly, for example. Then, the outdoor unit side controller 50 transmits a signal containing data on the calculated circulation composition to the relay unit side controller 60.

The relay unit side controller 60 calculates saturated liquid temperature and saturated gas temperature on the basis of the data on the circulation composition transmitted from the outdoor unit side controller 50 and the pressure detected by the refrigerant pressure detection device 36*a*. Furthermore, the relay unit side controller 60 calculates evaporating temperature for the heat exchangers 15 related to heat medium on the basis of the mean temperature of the saturated liquid temperature and the saturated gas temperature. The mean temperature may be simple average temperature or weighted mean temperature, as described above. Then, the relay unit side controller 60 calculates, as the degree of superheat, the difference between the temperature detected by the refrigerant inlet/outlet temperature detection device 35*a* and the calculated evaporating temperature, and controls the opening degree of the refrigerant expansion device 16*a* such that the degree of superheat becomes constant. Likewise, the relay unit side controller 60 controls the opening degree of the refrigerant expansion device 16*b* such that the degree of superheat becomes constant on the basis of the difference between the temperature detected by the refrigerant inlet/outlet temperature detection device 35*c* and the calculated evaporating temperature (the degree of superheat). The opening and closing device 17*a* is open, and the opening and closing device 17*b* is closed.

Here, supposing that the temperature detected by the refrigerant inlet/outlet temperature detection device 35*b* corresponds to the saturated liquid temperature or the temperature at a preset quality, saturation pressure and saturated gas temperature can be calculated on the basis of the circulation composition and the temperature detected by the refrigerant inlet/outlet temperature detection device 35*b*. Furthermore, the opening degrees of the refrigerant expansion devices 16*a* and 16*b* can be controlled on the basis of the saturation temperature calculated as the mean temperature of the saturated liquid temperature and the saturated gas temperature. In a case where the opening degree of the refrigerant expansion devices 16 are controlled on the basis of the above arithmetic process, the refrigerant pressure detection device 36*a* is not required. Therefore, the system can be configured at low cost.

Next, the flow of the heat medium in the heat medium circuit B will be described.

In the cooling only operation mode, both the heat exchanger 15*a* related to heat medium and the heat exchanger 15*b* related to heat medium transfer cooling energy of the heat source side refrigerant to the heat medium, and the pump 21*a* and the pump 21*b* allow the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cools the indoor space 7.

Then, the heat medium flows out of each of the use side heat exchanger 26*a* and the use side heat exchanger 26*b* and flows into the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space, such that the controlled flow rate of the heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger 15*a* related to heat medium and the heat exchanger 15*b* related to heat medium, and is again suctioned into the pump 21*a* and the pump 21*b*.

Note that in the pipes 5 of each use side heat exchanger 26, the heat medium is directed to flow from the second heat medium flow switching device 23 through the heat medium flow control device 25 to the first heat medium flow switching device 22. The air conditioning load required in the indoor space 7 can be obtained by controlling the difference between the temperature detected by the heat medium discharge temperature detection device 31*a* or the heat medium discharge temperature detection device 31*b* and the temperature detected by each of the heat medium outlet temperature detection devices 34 so that difference is maintained at a target value. As regards a temperature at the outlet of each heat exchanger 15 related to heat medium, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger 15*a* related to heat medium and the heat exchanger 15*b* related to heat medium are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. Referring to FIG. 8, the heat medium is supplied to the use side heat exchanger 26*a* and the use side heat exchanger 26*b* because these use side heat exchangers have heat loads. On the other hand, the use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 9:
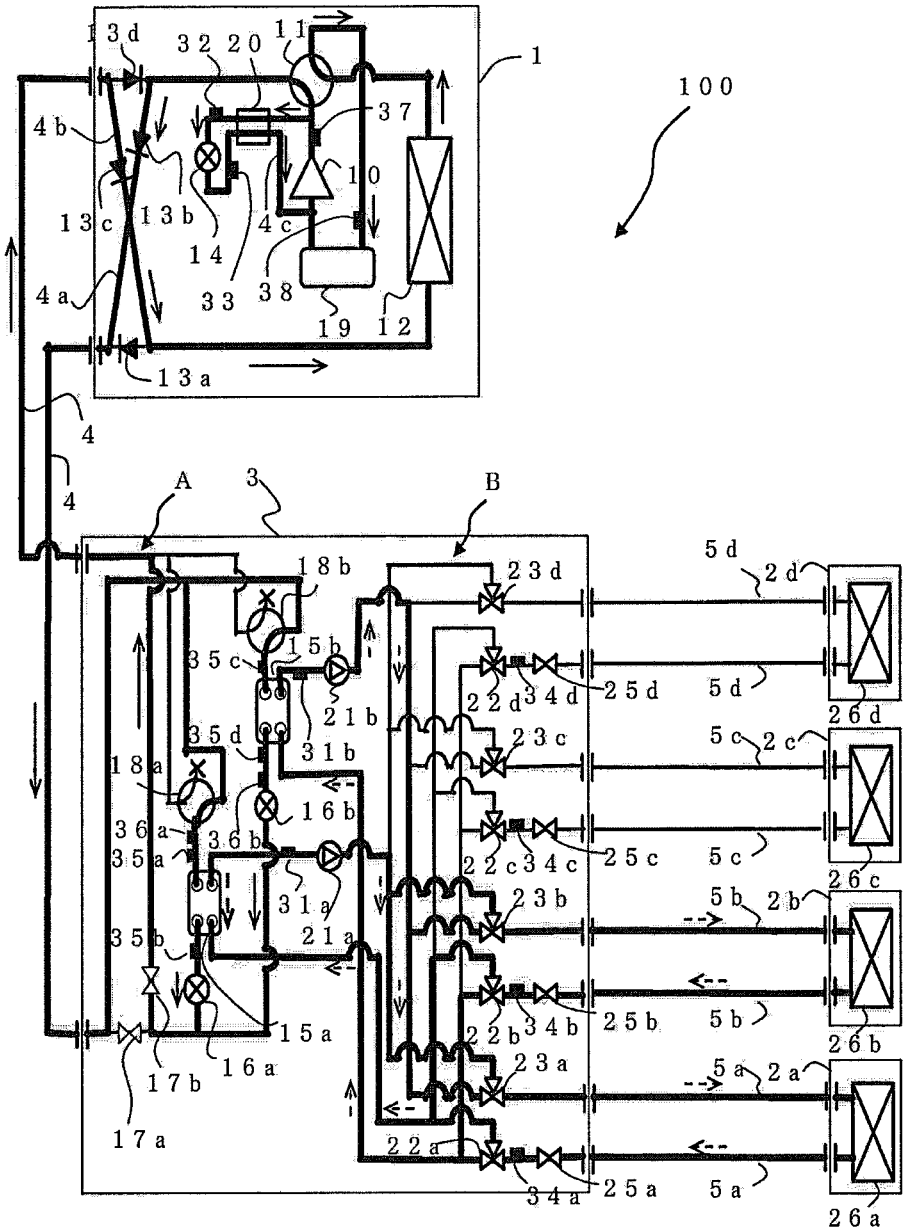
FIG. 9 is a system circuit diagram of the air-conditioning apparatus according to Embodiment during heating only operation.

FIG. 9 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 9. Furthermore, in FIG. 9, pipes indicated by thick lines correspond to pipes through which the refrigerants (the heat source side refrigerant and the heat medium) flow. In addition, the flow direction of the heat source side refrigerant is indicated by solid-line arrows and the flow direction of the heat medium is indicated by broken-line arrows in FIG. 9.

In the heating only operation mode illustrated in FIG. 9, the first refrigerant flow switching device 11 is switched such that the heat source side refrigerant discharged from the compressor 10 flows into the heat medium relay unit 3 without passing through the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the heat exchanger 15*b* related to heat medium, and each of the use side heat exchanger 26*a* and the use side heat exchanger 26*b*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature, high-pressure gas refrigerant that has flowed out of the outdoor unit 1 passes through the refrigerant pipe 4 and flows into the heat medium relay unit 3. The high-temperature, high-pressure gas refrigerant that has flowed into the heat medium relay unit 3 is branched, passes through the second refrigerant flow switching device 18*a* and the second refrigerant flow switching device 18*b*, and flows into the heat exchanger 15*a* related to heat medium and the heat exchanger 15*b* related to heat medium.

The high-temperature, high-pressure gas refrigerant that has flowed into each of the heat exchanger 15*a* related to heat medium and the heat exchanger 15*b* related to heat medium is condensed and liquefied into a high-pressure liquid refrigerant while transferring heat to the heat medium circulating in the heat medium circuit B. The liquid refrigerant flowing out of the heat exchanger 15*a* related to heat medium and that flowing out of the heat exchanger 15*b* related to heat medium are expanded into a low-temperature low-pressure, two-phase refrigerant in the expansion device 16*a* and the refrigerant expansion device 16*b*. This two-phase refrigerant passes through the opening and closing device 17*b*, flows out of the heat medium relay unit 3, passes through the refrigerant pipe 4, and again flows into the outdoor unit 1. The refrigerant, which has flowed into the outdoor unit 1, flows through the second connecting pipe 4*b*, passes through the check valve 13*c*, and flows into the heat source side heat exchanger 12, functioning as an evaporator.

Then, the refrigerant that has flowed into the heat source side heat exchanger 12 removes heat from the outdoor air in the heat source side heat exchanger 12 and thus turns into a low-temperature, low-pressure gas refrigerant. The low-temperature, low-pressure gas refrigerant flowing out of the heat source side heat exchanger 12 passes through the first refrigerant flow switching device 11 and the accumulator 19 and is suctioned into the compressor 10 again.

The outdoor unit side controller 50 performs the process of detecting circulation composition during the operation and transmits a signal containing data on the calculated circulation composition to the relay unit side controller 60.

The relay unit side controller 60 calculates saturated liquid temperature and saturated gas temperature on the basis of the data on the circulation composition transmitted from the outdoor unit side controller 50 and the pressure detected by the refrigerant pressure detection device 36*b*. Furthermore, the relay unit side controller 60 calculates condensing temperature for the heat exchangers 15 related to heat medium on the basis of the mean temperature of the saturated liquid temperature and the saturated gas temperature. The mean temperature may be simple average temperature or weighted mean temperature, as described above. Then, the relay unit side controller 60 calculates, as the degree of subcooling, the difference between the temperature detected by the refrigerant inlet/outlet temperature detection device 35*b* and the calculated condensing temperature, and controls the opening degree of the refrigerant expansion device 16*a* such that the degree of subcooling becomes constant. Likewise, the relay unit side controller 60 controls the opening degree of the refrigerant expansion device 16*b* such that the degree of subcooling becomes constant on the basis of the difference between the temperature detected by the refrigerant inlet/outlet temperature detection device 35*d* and the calculated condensing temperature (the degree of subcooling). The opening and closing device 17*a* is closed, and the opening and closing device 17*b* is open.

As described above, saturation pressure and saturated gas temperature can be calculated on the basis of the circulation composition and the temperature detected by the refrigerant inlet/outlet temperature detection device 35*b*. Therefore, the opening degree of the refrigerant expansion devices 16*a* and 16*b* can be controlled without the refrigerant pressure detection device 36*a*.

Next, the flow of the heat medium in the heat medium circuits B will be described.

In the heating only operation mode, both of the heat exchanger 15*a* related to heat medium and the heat exchanger 15*b* related to heat medium transfer heating energy of the heat source side refrigerant to the heat medium, and the pump 21*a* and the pump 21*b* allow the heated heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air in the use side heat exchanger 26*a* and the use side heat exchanger 26*b*, thus heats the indoor space 7.

Then, the heat medium flows out of each of the use side heat exchanger 26*a* and the use side heat exchanger 26*b* and flows into the heat medium flow control device 25*a* and the heat medium flow control device 25*b*. At this time, each of the heat medium flow control device 25*a* and the heat medium flow control device 25*b* controls the flow rate of the heat medium as necessary to cover the air conditioning load required in the indoor space, such that the controlled flow rate of the heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger 15*a* related to heat medium and the heat exchanger 15*b* related to heat medium, and is again suctioned into the pump 21*a* and the pump 21*b*.

Note that in the pipes 5 of each use side heat exchanger 26, the heat medium is directed to flow from the second heat medium flow switching device 23 through the heat medium flow control device 25 to the first heat medium flow switching device 22. The air conditioning load required in the indoor space 7 can be obtained by controlling the difference between the temperature detected by the heat medium discharge temperature detection device 31*a* or the heat medium discharge temperature detection device 31*b* and the temperature detected by each of the heat medium outlet temperature detection devices 34 so that difference is maintained at a target value. As regards a temperature at the outlet of each heat exchanger 15 related to heat medium, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger 15*a* related to heat medium and the heat exchanger 15*b* related to heat medium are established. Although the use side heat exchanger 26*a* should essentially be controlled on the basis of the difference between a temperature at its inlet and that at its outlet, since the temperature of the heat medium on the inlet side of the use side heat exchanger 26 is substantially the same as that detected by the heat medium discharge temperature detection device 31*b*. Therefore, the number of temperature sensors can be reduced by employing the heat medium discharge temperature detection device 31*b*. Accordingly, the system can be configured at low cost.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. Referring to FIG. 9, the heat medium is supplied to the use side heat exchanger 26*a* and the use side heat exchanger 26*b* because these use side heat exchangers have heat loads. On the other hand, the use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 10:
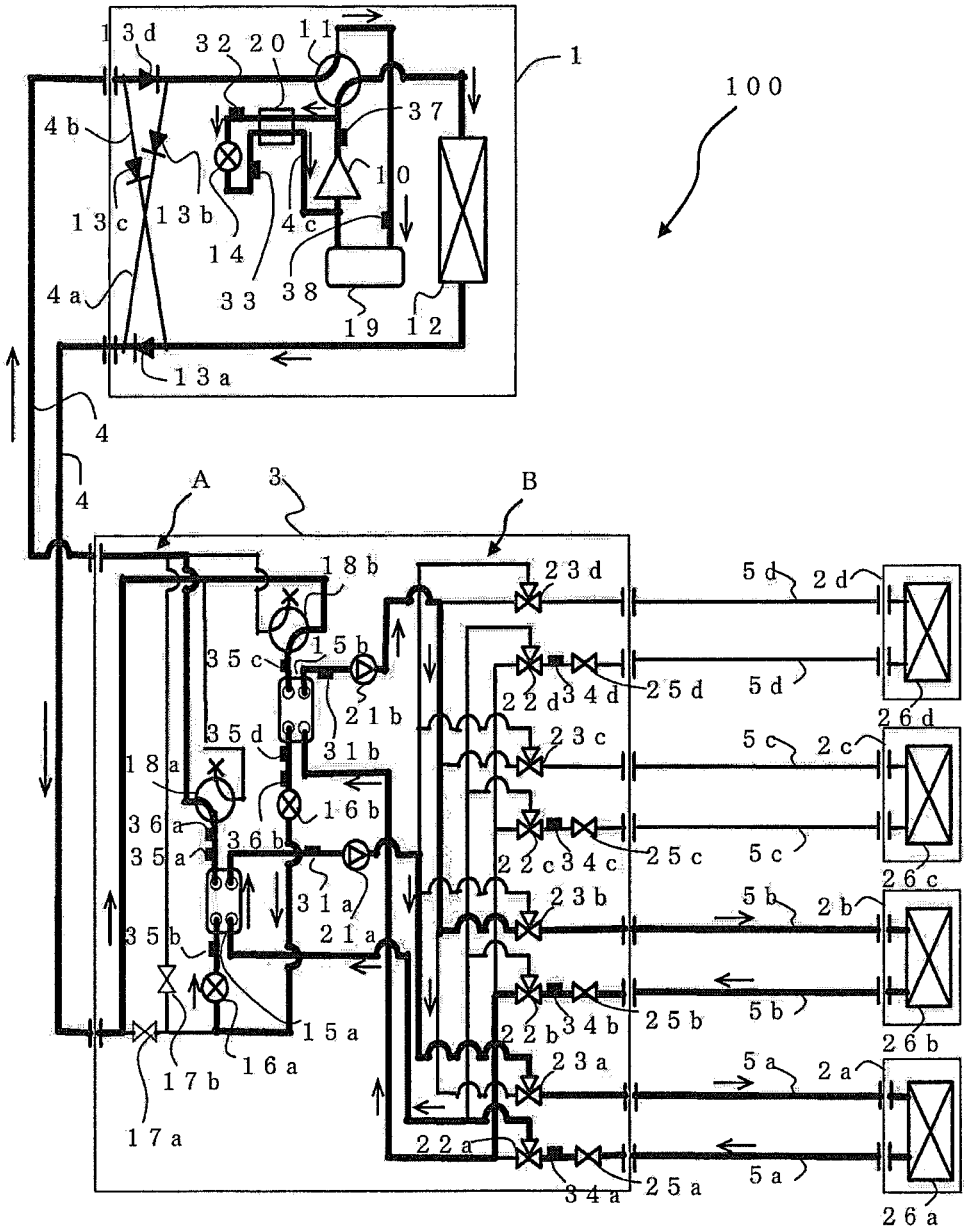
FIG. 10 is a system circuit diagram of the air-conditioning apparatus according to Embodiment during cooling main operation.

FIG. 10 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 10. Furthermore, in FIG. 10, pipes indicated by thick lines correspond to pipes through which the refrigerants (the heat source side refrigerant and the heat medium) circulate. In addition, the flow direction of the heat source side refrigerant is indicated by solid-line arrows and the flow direction of the heat medium is indicated by broken-line arrows in FIG. 10.

In the cooling main operation mode illustrated in FIG. 10, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between the heat exchanger 15*a* related to heat medium and the use side heat exchanger 26*a*, and between the heat exchanger 15*b* related to heat medium and the use side heat exchanger 26*b*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant, which has flowed out of the heat source side heat exchanger 12, passes through the check valve 13*a*, flows out of the outdoor unit 1, passes through the refrigerant pipe 4, and flows into the heat medium relay unit 3. The two-phase refrigerant, which has flowed into the heat medium relay unit 3, passes through the second refrigerant flow switching device 18*b* and flows into the heat exchanger 15*b* related to heat medium, functioning as a condenser.

The two-phase refrigerant which has flowed into the heat exchanger 15*b* related to heat medium is condensed and liquefied while transferring heat to the heat medium circulating in the heat medium circuit B, and turns into a liquid refrigerant. The liquid refrigerant flowing out of the heat exchanger 15*b* related to heat medium is expanded into a low-pressure, two-phase refrigerant by the refrigerant expansion device 16*b*. This low-pressure, two-phase refrigerant flows through the refrigerant expansion device 16*a* and into the heat exchanger 15*a* related to heat medium functioning as an evaporator. The low pressure, two-phase refrigerant, which has flowed into the heat exchanger 15*a* related to heat medium, removes heat from the heat medium circulating in the heat medium circuits B to cool the heat medium, and thus turns into a low-pressure gas refrigerant. The gas refrigerant flows out of the heat exchanger 15*a* related to heat medium, passes through the second refrigerant flow switching device 18*a*, flows out of the heat medium relay unit 3, and flows into the outdoor unit 1 again through the refrigerant pipe 4. The refrigerant which has flowed into the outdoor unit 1 passes through the check valve 13*d*, the first refrigerant flow switching device 11, and the accumulator 19, and is again suctioned into the compressor 10.

The outdoor unit side controller 50 performs the process of detecting circulation composition during the operation and transmits a signal containing data on the calculated circulation composition to the relay unit side controller 60.

The relay unit side controller 60 calculates saturated liquid temperature and saturated gas temperature on the basis of the data on the circulation composition transmitted from the outdoor unit side controller 50 and the pressure detected by the refrigerant pressure detection device 36*a*. Furthermore, the relay unit side controller 60 calculates evaporating temperature for the heat exchangers 15 related to heat medium on the basis of the mean temperature of the saturated liquid temperature and the saturated gas temperature. The mean temperature may be simple average temperature or weighted mean temperature, as described above. Then, the relay unit side controller 60 calculates, as the degree of superheat, the difference between the temperature detected by the refrigerant inlet/outlet temperature detection device 35*a* and the calculated evaporating temperature, and controls the opening degree of the refrigerant expansion device 16*b* such that the degree of superheat becomes constant. At this time, the refrigerant expansion device 16*a* is fully opened, the opening and closing device 17*a* is closed, and opening and closing device 17*b* is closed.

In this process, regarding the refrigerant expansion device 16*b*, condensing temperature may be obtained as the mean temperature of the saturated liquid temperature and the saturated gas temperature calculated on the basis of the circulation composition and the pressure detected by the refrigerant pressure detection device 36*b*. Then, the opening degree may be controlled such that the degree of subcooling obtained as the difference between the calculated condensing temperature and the temperature detected by the refrigerant inlet/outlet temperature detection device 35*d* becomes constant. Alternatively, the degree of superheat or the degree of subcooling may be controlled by using the refrigerant expansion device 16*a* while the refrigerant expansion device 16*b* is fully open.

As described above, saturation pressure and saturated gas temperature can be calculated on the basis of the circulation composition and the temperature detected by the refrigerant inlet/outlet temperature detection device 35*b*. Therefore, the opening degree of the refrigerant expansion devices 16*a* and 16*b* can be controlled without the refrigerant pressure detection device 36*a*.

Next, the flow of the heat medium in the heat medium circuit B will be described.

In the cooling main operation mode, the heat exchanger 15*b* related to heat medium transfers heating energy of the heat source side refrigerant to the heat medium, and the pump 21*b* allows the heated heat medium to flow through the pipes 5. Furthermore, in the cooling main operation mode, the heat exchanger 15*a* related to heat medium transfers cooling energy of the heat source side refrigerant to the heat medium, and the pump 21*a* allows the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, each of the heat medium flow control device 25*a* and the heat medium flow control device 25*b* controls the flow rate of the heat medium as necessary to cover the air conditioning load required in the indoor space, such that the controlled flow rate of the heat medium flows into the corresponding one of the use side heat exchanger 26*a* and the use side heat exchanger 26*b*. The heat medium, which has passed through the use side heat exchanger 26*b* with a slight decrease of temperature, passes through the heat medium flow control device 25*b* and the first heat medium flow switching device 22*b*, flows into the heat exchanger 15*b* related to heat medium, and is suctioned into the pump 21*b* again. The heat medium, which has passed through the use side heat exchanger 26*a* with a slight increase of temperature, passes through the heat medium flow control device 25*a* and the first heat medium flow switching device 22*a*, flows into the heat exchanger 15*a* related to heat medium, and is then suctioned into the pump 21*a* again.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipes 5 of each use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the heat medium discharge temperature detection device 31*b* and that detected by a corresponding one of the heat medium outlet temperature detection devices 34 is controlled such that the difference is kept at a target value, so that the heating air conditioning load required in the indoor space 7 can be covered. The difference between the temperature detected by a corresponding one of the heat medium outlet temperature detection devices 34 and that detected by the heat medium discharge temperature detection sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. Referring to FIG. 10, the heat medium is supplied to the use side heat exchanger 26*a* and the use side heat exchanger 26*b* because these use side heat exchangers have heat loads. On the other hand, the use side heat exchanger 26*c* and the use side heat exchanger 26*d* have no heat load and the corresponding heat medium flow control devices 25*c* and 25*d* are fully closed. When a heat load is generated in the use side heat exchanger

26*c* or the use side heat exchanger 26*d*, the heat medium flow control device 25*c* or the heat medium flow control device 25*d* may be opened such that the heat medium is circulated.

[Heating Main Operation Mode]

Figure 11:
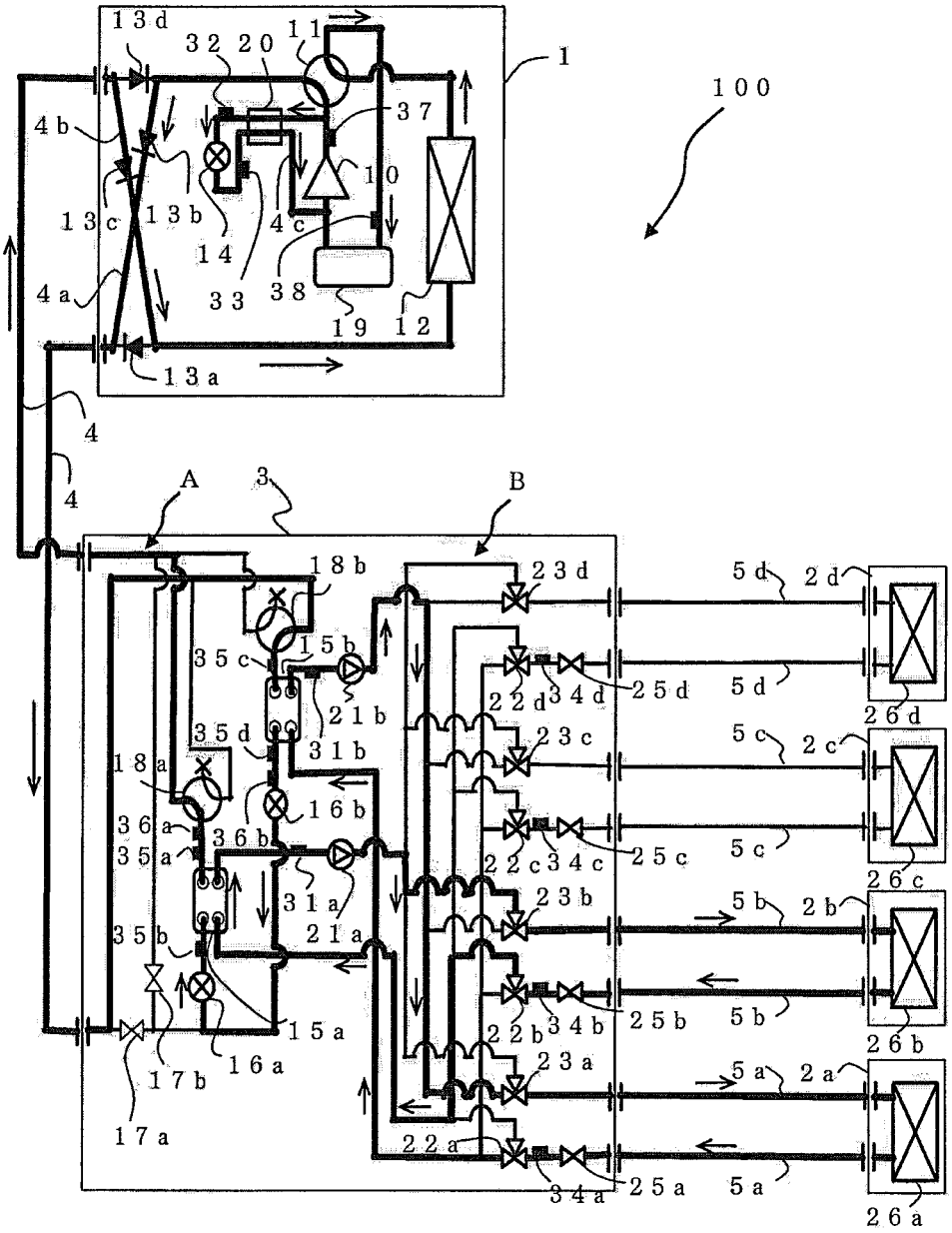
FIG. 11 is a system circuit diagram of the air-conditioning apparatus according to Embodiment during heating main operation.

FIG. 11 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 11. Furthermore, in FIG. 11, pipes indicated by thick lines correspond to pipes through which the refrigerants (the heat source side refrigerant and the heat medium) circulate. In addition, the flow direction of the heat source side refrigerant is indicated by solid-line arrows and the flow direction of the heat medium is indicated by broken-line arrows in FIG. 11.

In the heating main operation mode illustrated in FIG. 11, in the outdoor unit 1, the first refrigerant flow switching device 11 is allowed to perform switching such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed such that the heat medium circulates between each of the heat exchanger 15*a* related to heat medium and the use side heat exchanger 26*a*, and between the heat exchanger 15*b* related to heat medium and the use side heat exchanger 26*b*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature, high-pressure gas refrigerant that has flowed out of the outdoor unit 1 passes through the refrigerant pipe 4 and flows into the heat medium relay unit 3. The high-temperature high-pressure gas refrigerant that has flowed into the heat medium relay unit 3 passes through the second refrigerant flow switching device 18*b* and flows into the heat exchanger 15*b* related to heat medium functioning as a condenser.

The gas refrigerant that has flowed into the heat exchanger 15*b* related to heat medium is condensed and liquefied while transferring heat to the heat medium circulating in the heat medium circuit B, and turns into a liquid refrigerant. The liquid refrigerant flowing out of the heat exchanger 15*b* related to heat medium is expanded into a low-pressure, two-phase refrigerant by the refrigerant expansion device 16*b*. This low-pressure, two-phase refrigerant flows through the refrigerant expansion device 16*a* and into the heat exchanger 15*a* related to heat medium functioning as an evaporator. The low-pressure two-phase refrigerant that has flowed into the heat exchanger 15*a* related to heat medium removes heat from the heat medium circulating in the heat medium circuit B, is evaporated to cool the heat medium. This low-pressure, two-phase refrigerant flows out of the heat exchanger 15*a* related to heat medium, passes through the second refrigerant flow switching device 18*a*, flows out of the heat medium relay unit 3, passes through the refrigerant pipe 4, and again flows into the outdoor unit 1.

The refrigerant that has flowed into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature, low-pressure gas refrigerant. The low-temperature, low-pressure gas refrigerant flowing out of the heat source side heat exchanger 12 passes through the first refrigerant flow switching device 11 and the accumulator 19 and is suctioned into the compressor 10 again.

The relay unit side controller 60 calculates saturated liquid temperature and saturated gas temperature on the basis of the data on the circulation composition transmitted from the outdoor unit side controller 50 and the pressure detected by the refrigerant pressure detection device 36*b*. Furthermore, the relay unit side controller 60 calculates condensing temperature for the heat exchangers 15 related to heat medium on the basis of the mean temperature of the saturated liquid temperature and the saturated gas temperature. The mean temperature may be simple average temperature or weighted mean temperature, as described above. Then, the relay unit side controller 60 calculates, as the degree of subcooling, the difference between the temperature detected by the refrigerant inlet/outlet temperature detection device 35*b* and the calculated condensing temperature, and controls the opening degree of the refrigerant expansion device 16*b* such that the degree of subcooling becomes constant. Further, the refrigerant expansion device 16*a* is fully opened, the opening and closing device 17*a* is closed, and opening and closing device 17*b* is closed. Alternatively, the degree of subcooling may be controlled by using the refrigerant expansion device 16*a* while the refrigerant expansion device 16*b* is fully open.

As described above, saturation pressure and saturated gas temperature can be calculated on the basis of the circulation composition and the temperature detected by the refrigerant inlet/outlet temperature detection device 35*b*. Therefore, the opening degree of the refrigerant expansion devices 16*a* and 16*b* can be controlled without the refrigerant pressure detection device 36*a*.

Next, the flow of the heat medium in the heat medium circuit B will be described.

In the heating main operation mode, the heat exchanger 15*b* related to heat medium transfers heating energy of the heat source side refrigerant to the heat medium, and the pump 21*b* allows the heated heat medium to flow through the pipes 5. Furthermore, in the heating main operation mode, the heat exchanger 15*a* related to heat medium transfers cooling energy of the heat source side refrigerant to the heat medium and the pump 21*a* allows the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cooling the indoor space 7. In addition, in the use side heat exchanger 26*a*, the heat medium transfers heat to the indoor air, thus heats the indoor space 7. At this time, each of the heat medium flow control device 25*a* and the heat medium flow control device 25*b* controls a flow rate of the heat medium as necessary to cover an air conditioning load required in the indoor space, such that the controlled flow rate of the heat medium flows into the corresponding one of the use side heat exchanger 26*a* and the use side heat exchanger 26*b*. The heat medium, which has passed through the use side heat exchanger 26*b* with a slight increase of temperature, passes through the heat medium flow control device 25*b* and the first heat medium flow switching device 22*b*, flows into the heat exchanger 15*a* related to heat medium, and is suctioned into the pump 21*a* again. The heat medium, which has passed through the use side heat exchanger 26*a* with a slight decrease of temperature, passes through the heat medium flow control device 25*a* and the first heat medium flow switching device 22*a*, flows into the heat exchanger 15*b* related to heat medium, and is again suctioned into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipes 5 of each use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the heat medium discharge temperature detection device 31*b* and that detected by a corresponding one of the heat medium outlet temperature detection devices 34 is controlled such that the difference is kept at a target value, so that the heating air conditioning load required in the indoor space 7 can be covered. The difference between the temperature detected by a corresponding one of the heat medium outlet temperature detection devices 34 and that detected by the heat medium discharge temperature detection sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the use side heat exchanger 26. In FIG. 11, the heat medium is supplied to the use side heat exchanger 26*a* and the use side heat exchanger 26*b* because these use side heat exchangers have heat loads. On the other hand, the use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerant Pipes 4]

As described above, the air-conditioning apparatus 100 according to Embodiment 1 has several operation modes. In these operation modes, the heat source side refrigerant flows through the pipes 4 connecting the outdoor unit 1 and the heat medium relay unit 3.

[Pipes 5]

In some operation modes carried out by the air-conditioning apparatus 100 according to Embodiment, the heat medium, such as water or antifreeze, flows through the pipes 5 connecting the heat medium relay unit 3 and the indoor units 2.

The above description concerns a case where the refrigerant pressure detection device 36*a* is disposed in a passage between the heat exchanger 15*a* related to heat medium functioning on the cooling side in the cooling and heating mixed operation and the second refrigerant flow switching device 18*a*, and the refrigerant pressure detection device 36*b* is disposed in a passage between the heat exchanger 15*b* related to heat medium functioning on the heating side in the cooling and heating mixed operation and the refrigerant expansion device 16*b*. In such a configuration, saturated temperature can be calculated accurately even if any pressure loss occurs in the heat exchangers 15*a* and 15*b* related to heat medium. However, the pressure loss on the condensation side is small. Therefore, the refrigerant pressure detection device 36*b* may be disposed in a passage between the heat exchanger 15*b* related to heat medium and the refrigerant expansion device 16*b*. In such a configuration, calculation accuracy does not deteriorate significantly. An evaporator causes a relatively large pressure loss. For example, in a case where heat exchangers related to heat medium in which the amount of pressure loss can be estimated or is small are employed, the refrigerant pressure detection device 36*a* may be disposed in a passage between the heat exchanger 15*a* related to heat medium and the second refrigerant flow switching device 18*a*. For example, in the cooling only operation mode and in the cooling main operation mode, the relay unit side controller 60 calculates saturated liquid temperature and saturated gas temperature on the basis of the data on the circulation composition transmitted from the outdoor unit side controller 50 and the pressure detected by the refrigerant pressure detection device 36*a*, and controls at least one of the expansion device 16*a* and the expansion device 16*b*. Further, in the heating only operation mode and in the heating main operation mode, the relay unit side controller 60 calculates saturated liquid temperature and saturated gas temperature on the basis of the circulation composition transmitted from the outdoor unit side controller 50 and the pressure detected by the refrigerant pressure detection device 36*b*, and controls at least one of the expansion device 16*a* and the expansion device 16*b*.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are set to a medium opening degree, such that the heat medium flows into both of the heat exchanger 15*a* related to heat medium and the heat exchanger 15*b* related to heat medium. Consequently, since both of the heat exchanger 15*a* related to heat medium and the heat exchanger 15*b* related to heat medium can be used for the heating operation or the cooling operation, the heat transfer area can be increased, and accordingly the heating operation or the cooling operation can be efficiently performed.

In addition, in the case in which the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchanger 15*b* related to heat medium for heating, and the first heat medium flow switching device 22 and the second heat medium flow switching device 23 corresponding to the use side heat exchanger 26 which performs the cooling operation are switched to the passage connected to the heat exchanger 15*a* related to heat medium for cooling, so that the heating operation or cooling operation can be freely performed in each indoor unit 2.

Furthermore, each of the first heat medium flow switching devices 22 and the second heat medium flow switching devices 23 described in Embodiment may be any component which can switch passages, for example, a three-way valve capable of switching between three passages or a combination of two opening and closing valves and the like switching between two passages. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, while Embodiment has been described with respect to the case in which the heat medium flow control devices 25 each include a two-way valve, each of the heat medium flow control devices 25 may include a control valve having three passages and the valve may be disposed with a bypass pipe that bypasses the corresponding use side heat exchanger 26.

Furthermore, as regards each of the use side heat medium flow control device 25, a stepping-motor-driven type that is capable of controlling a flow rate in the passage is preferably used. Alternatively, a two-way valve or a three-way valve whose one end is closed may be used. Alternatively, as regards each use side heat medium flow control device 25, a component, such as an on-off valve, which is capable of opening or closing a two-way passage, may be used while ON and OFF operations are repeated to control an average flow rate.

Furthermore, while each second refrigerant flow switching device 18 is illustrated as a four-way valve, the device is not limited to this valve. A plurality of two-way or three-way flow switching valves may be used such that the refrigerant flows in the same way.

While the air-conditioning apparatus 100 according to Embodiment has been described with respect to the case in which the apparatus can perform the cooling and heating mixed operation, the apparatus is not limited to this case. Even in an apparatus that is configured by a single heat exchanger 15 related to heat medium and a single refrigerant expansion device 16 that are connected to a plurality of parallel use side heat exchangers 26 and heat medium flow control valves 25, and is capable of carrying out only a cooling operation or a heating operation, the same advantages can be obtained.

In addition, it is needless to say that the same holds true for the case in which only a single use side heat exchanger 26 and a single heat medium flow control valve 25 are connected. Moreover, obviously, there is no problem even if a plurality of components acting in the same way are arranged as the heat exchanger 15 related to heat medium and the refrigerant expansion device 16. Furthermore, while the case in which the heat medium flow control valves 25 are equipped in the heat medium relay unit 3 has been described, the arrangement is not limited to this case. Each heat medium flow control valve 25 may be disposed in the indoor unit 2. The heat medium relay unit 3 and the indoor unit 2 may be constituted in different housings.

As the heat medium, for example, brine (antifreeze), water, a mixed solution of brine and water, or a mixed solution of water and an additive with high anticorrosive effect can be used. In the air-conditioning apparatus 100, therefore, if the heat medium leaks through the indoor unit 2 into the indoor space 7, the safety of the heat medium used is high. Accordingly, it contributes to safety improvement.

Further, although the heat source side heat exchanger 12 and the use side heat exchangers 26*a* to 26*d* are typically arranged with an air-sending device which facilitates condensation or evaporation, the arrangement is not limited to the above. For example, a panel heater, using radiation can be used as the use side heat exchangers 26*a* to 26*d* and a water-cooled heat exchanger which transfers heat using water or antifreeze can be used as the heat source side heat exchanger 12. Any component that has a structure that can transfer or remove heat may be used.

Furthermore, while an exemplary description in which there are four use side heat exchangers 26*a* to 26*d* has been given, any number can be connected.

Furthermore, description has been made illustrating a case in which there are two heat exchangers 15 related to heat medium, namely, heat exchanger 15*a* related to heat medium and heat exchanger 15*b* related to heat medium. As a matter of course, the arrangement is not limited to this case, and as long as it is configured to be capable of cooling and/or heating of the heat medium, the number of heat exchangers 15 related to heat medium arranged is not limited.

Furthermore, each of the number of pumps 21*a* and 21*b* is not limited to one. A plurality of pumps having a small capacity may be used in parallel.

While controllers have been described to include the outdoor unit side controller 50 and the relay unit side controller 60 which are connected to each other by a communication line or the like and are configured to cooperate in performing processes, the way the controllers are provided, the way the controllers perform processes, and so forth are not limited thereto. For example, the outdoor unit side controller 50 and the relay unit side controller 60 may be integrated into one controller so that all processes concerning the air-conditioning apparatus can be performed by the one controller. Moreover, the air-conditioning apparatus may be controlled by a controller disposed in a place other than in the outdoor unit 1 or in the heat medium relay unit 3.

While the above air-conditioning apparatus is configured by the refrigerant circuit A and the heat medium circuit B, the invention is also applicable to an air-conditioning apparatus configured by the refrigerant circuit A.

The invention claimed is:

1. An air-conditioning apparatus comprising:

a refrigeration cycle device including a refrigerant circuit in which a compressor that sends a zeotropic refrigerant mixture containing tetrafluoropropene and R32, a refrigerant flow switching device for switching a passage through which the refrigerant circulates, a heat source side heat exchanger for exchanging heat of the refrigerant, a refrigerant expansion device for controlling pressure of the refrigerant, and a heat exchanger related to heat medium that is capable of exchanging heat between the refrigerant and a heat medium different from the refrigerant are connected by pipes, circulating the refrigerant, the refrigeration cycle device further including a circulating refrigerant composition detection circuit having a low-pressure side pressure detection device for detecting low-pressure side pressure corresponding to pressure of the refrigerant that is to be suctioned by the compressor, a high-low pressure bypass pipe connecting a pipe on a discharge side of the compressor and a pipe on a suction side of the compressor, a bypass expansion device disposed in the high-low pressure bypass pipe, a high-pressure side temperature detection device for detecting high-pressure side temperature corresponding to temperature of the refrigerant flowing into the bypass expansion device, a low-pressure side temperature detection device for detecting low-pressure side temperature corresponding to temperature of the refrigerant discharged from the bypass expansion device, and a heat exchanger related to refrigerant that exchanges heat between the refrigerant flowing into the bypass expansion device and the refrigerant discharged from the bypass expansion device;

a heat medium side device including a heat medium circuit in which a heat medium sending device for circulating the heat medium to be used for the heat exchange performed by the heat exchanger related to heat medium, a use side heat exchanger that exchanges heat between the heat medium and air in a space to be conditioned, and a heat medium flow switching device that switches to pass the heat medium having flowed through the heat exchanger related to heat medium toward the use side heat exchanger are connected by pipes;

a first controller that detects a circulation composition of the zeotropic refrigerant mixture in the refrigeration cycle device on the basis of at least the low-pressure side pressure, the high-pressure side temperature, and the low-pressure side temperature, and changes a driving frequency of the compressor based on, and in response to, a detected circulation composition data of the zeotropic refrigerant mixture that corresponds to circulation composition of the zeotropic refrigerant mixture; and a second controller disposed at a position away from the first controller and connecting to be capable of communicating to the first controller with wire or no wire, the second controller performing, in a heat medium relay unit including the heat exchanger related to heat medium, at least one of a calculation of evaporating temperature of the heat exchanger related to heat medium that functions as an evaporator and degree of superheat on a refrigerant outlet side of the heat exchanger related to heat medium that functions as an evaporator and a calculation of condensing temperature of the heat exchanger related to heat medium that functions as a condenser and degree of subcooling on the refrigerant outlet side of the heat exchanger related to heat medium that functions as a condenser, on the basis of the circulation composition received through the communication with the first controller, wherein at least the compressor, the refrigerant flow switching device, the heat source side heat exchanger, and the circulating refrigerant composition detection circuit are accommodated in an outdoor unit, at least the heat exchanger related to heat medium and the refrigerant expansion device are accommodated in the heat medium relay unit, the outdoor unit and the heat medium relay unit are provided separately and are installable at separate positions to be away from each other, the first controller is provided in or near the outdoor unit, the second controller is disposed in or near the heat medium relay unit, and the heat exchanger related to heat medium is one of a plurality of heat exchangers related to heat medium, including at least a first heat exchanger related to heat medium and a second heat exchanger related to heat medium;

the air-conditioning apparatus further comprising:

a first refrigerant temperature detection device, connected to an inlet end of the first heat exchanger related to heat medium, for detecting temperature on a refrigerant inlet side when the heat exchanger related to heat medium is functioning as a condenser;

a second refrigerant temperature detection device, different from the first temperature detection device, and connected to an outlet end of the second heat exchanger related to heat medium, for detecting temperature on the refrigerant outlet side when the heat exchanger related to heat medium is functioning as a condenser;

a first refrigerant pressure detection device connected to an outlet end of the first heat exchanger related to heat medium and to the first refrigerant temperature detection device, and disposed directly between the heat exchanger related to heat medium and the refrigerant flow switching device, for detecting pressure of the refrigerant flowing into the first heat exchanger related to heat medium; and a second refrigerant pressure detection device, different from the first refrigerant pressure detection device, and connected to an inlet end of the second heat exchanger related to heat medium, the inlet end of the second heat exchanger related to heat medium being opposite to the outlet end of the first heat exchanger related to heat medium to which the first refrigerant pressure detection device is connected, and to the second refrigerant temperature detection device, for detecting pressure of refrigerant discharged from the second heat exchanger related to heat medium when functioning as a condenser;

wherein the second controller is configured to determine the pressure of the refrigerant discharged and entered from at least one of the plurality of heat exchangers related to heat medium irrespective of a current operational mode, as the first refrigerant pressure detection device and the second refrigerant pressure detection device are located on opposite sides of their respective heat exchangers, calculate the degree of superheat of the plurality of heat exchangers related to heat medium functioning as an evaporator on the basis of the detected circulation composition data of the zeotropic refrigerant mixture, the pressure detected by the first refrigerant pressure detection device, and the temperature detected by the first refrigerant temperature detection device, and calculate the degree of subcooling of the plurality of heat exchangers related to heat medium functioning as a condenser on the basis of the detected circulation composition data of the zeotropic refrigerant mixture, the pressure detected by the first refrigerant pressure detection device, and the temperature detected by the second refrigerant temperature detection device.

2. The air-conditioning apparatus of claim 1, wherein the second controller calculates, on the basis of the circulation composition and the pressure detected by the first refrigerant pressure detection device, saturated liquid refrigerant temperature and saturated gas refrigerant temperature at the detected pressure, calculates at least one of the condensing temperature and the evaporating temperature of the refrigerant on the basis of the saturated liquid refrigerant temperature and the saturated gas refrigerant temperature, and then controls opening degree of the refrigerant expansion device.

3. The air-conditioning apparatus of claim 2, wherein mean temperature of the saturated liquid refrigerant temperature and the saturated gas refrigerant temperature is taken as the condensing temperature or the evaporating temperature.

4. An air-conditioning apparatus comprising:

a refrigeration cycle device including a refrigerant circuit in which a compressor that sends a zeotropic refrigerant mixture containing tetrafluoropropene and R32, a refrigerant flow switching device for switching a passage through which the refrigerant circulates, a heat source side heat exchanger for exchanging heat of the refrigerant, a refrigerant expansion device for controlling pressure of the refrigerant, and a heat exchanger related to heat medium that is capable of exchanging heat between the refrigerant and a heat medium different from the refrigerant are connected by pipes, circulating the refrigerant, the refrigeration cycle device further including a circulating refrigerant composition detection circuit having a low-pressure side pressure detection device for detecting low-pressure side pressure corresponding to pressure of the refrigerant that is to be suctioned by the compressor, a high-low pressure bypass pipe connecting a pipe on a discharge side of the compressor and a pipe on a suction side of the compressor, a bypass expansion device disposed in the high-low pressure bypass pipe, a high-pressure side temperature detection device for detecting high-pressure side temperature corresponding to temperature of the refrigerant flowing into the bypass expansion device, a low-pressure side temperature detection device for detecting low-pressure side temperature corresponding to temperature of the refrigerant discharged from the bypass expansion device, and a heat exchanger related to refrigerant that exchanges heat between the refrigerant flowing into the bypass expansion device and the refrigerant discharged from the bypass expansion device;

a heat medium side device including a heat medium circuit in which a heat medium sending device for circulating the heat medium to be used for the heat exchange performed by the heat exchanger related to heat medium, a use side heat exchanger that exchanges heat between the heat medium and air in a space to be conditioned, and a heat medium flow switching device that switches to pass the heat medium having flowed through the heat exchanger related to heat medium toward the use side heat exchanger are connected by pipes;

a first controller that detects a circulation composition of the zeotropic refrigerant mixture in the refrigeration cycle device on the basis of at least the low-pressure side pressure, the high-pressure side temperature, and the low-pressure side temperature, and changes a driving frequency of the compressor based on, and in response to, a detected circulation composition data of the zeotropic refrigerant mixture that corresponds to the circulation composition of the zeotropic refrigerant mixture; and a second controller disposed at a position away from the first controller and connecting to be capable of communicating to the first controller with wire or no wire, the second controller performing, in a heat medium relay unit including the heat exchanger related to heat medium, at least one of a calculation of evaporating temperature of the heat exchanger related to heat medium that functions as an evaporator and degree of superheat on a refrigerant outlet side of the heat exchanger related to heat medium that functions as an evaporator and a calculation of condensing temperature of the heat exchanger related to heat medium that functions as a condenser and degree of subcooling on the refrigerant outlet side of the heat exchanger related to heat medium that functions as a condenser, on the basis of the circulation composition received through the communication with the first controller, wherein at least the compressor, the refrigerant flow switching device, the heat source side heat exchanger, and the circulating refrigerant composition detection circuit are accommodated in an outdoor unit, at least the heat exchanger related to heat medium and the refrigerant expansion device are accommodated in the heat medium relay unit, the outdoor unit and the heat medium relay unit are provided separately and are installable at separate positions to be away from each other, the first controller is provided in or near the outdoor unit, the second controller is disposed in or near the heat medium relay unit, and the heat exchanger related to heat medium is one of a plurality of heat exchangers related to heat medium, including at least a first heat exchanger related to heat medium and a second heat exchanger related to heat medium;

the air-conditioning apparatus further comprising:

a first refrigerant temperature detection device, connected to an inlet end of the first heat exchanger related to heat medium, for detecting temperature on a refrigerant inlet side when the heat exchanger related to heat medium is functioning as a condenser;

a second refrigerant temperature detection device, different from the first temperature detection device, and connected to an outlet end of the second heat exchanger related to heat medium, for detecting temperature on the refrigerant outlet side when the heat exchanger related to heat medium is functioning as a condenser; and a first refrigerant pressure detection device connected to an outlet end of the first heat exchanger related to heat medium and to the first refrigerant temperature detection device, and disposed directly between the heat exchanger related to heat medium and the refrigerant flow switching device, for detecting pressure of the refrigerant flowing into the first heat exchanger related to heat medium; and a second refrigerant pressure detection device, different from the first refrigerant pressure detection device, and connected to an inlet end of the second heat exchanger related to heat medium, the inlet end of the second heat exchanger related to heat medium being opposite to the outlet end of the first heat exchanger related to heat medium to which the first refrigerant pressure detection device is connected, and to the second refrigerant temperature detection device, for detecting pressure of refrigerant discharged from the second heat exchanger related to heat medium when functioning as a condenser;

wherein the second controller is configured to determine the pressure of the refrigerant discharged and entered from at least one of the plurality of heat exchangers related to heat medium irrespective of a current operational mode, as the first refrigerant pressure detection device and the second refrigerant pressure detection device are located on opposite sides of their respective heat exchangers, calculate the degree of superheat of the plurality of heat exchangers related to heat medium functioning as an evaporator on the basis of the detected circulation composition data of the zeotropic refrigerant mixture, the temperature detected by the first refrigerant temperature detection device, and the temperature detected by the second refrigerant temperature detection device, calculate the degree of subcooling of the plurality of heat exchangers related to heat medium functioning as a condenser on the basis of the detected circulation composition data of the zeotropic refrigerant mixture, the pressure detected by the first refrigerant pressure detection device, and the temperature detected by the second refrigerant temperature detection device.

5. The air-conditioning apparatus of claim 4, wherein the second controller calculates, on the basis of the circulation composition and the pressure detected by the first refrigerant pressure detection device, saturated liquid refrigerant temperature and saturated gas refrigerant temperature at the detected pressure, calculates the condensing temperature of the refrigerant on the basis of the saturated liquid refrigerant temperature and the saturated gas refrigerant temperature, calculates, on the basis of the circulation composition and the temperature detected by the second refrigerant temperature detection device, evaporating pressure, in which the detected temperature is taken as the saturated liquid refrigerant temperature or a preset quality, calculates saturated gas refrigerant temperature on the basis of the circulation composition and the evaporating pressure, calculates the evaporating temperature of the refrigerant on the basis of the saturated liquid refrigerant temperature and the saturated gas refrigerant temperature at the evaporating pressure, and then controls opening degree of the refrigerant expansion device.

6. The air-conditioning apparatus of claim 5, wherein mean temperature of the saturated liquid refrigerant temperature and the saturated gas refrigerant temperature is taken as the condensing temperature or the evaporating temperature.

7. An air-conditioning apparatus comprising:

a refrigeration cycle device including a refrigerant circuit in which a compressor that sends a zeotropic refrigerant mixture containing tetrafluoropropene and R32, a refrigerant flow switching device for switching a passage through which the refrigerant circulates, a heat source side heat exchanger for exchanging heat of the refrigerant, a refrigerant expansion device for controlling pressure of the refrigerant, and a heat exchanger related to heat medium that is capable of exchanging heat between the refrigerant and a heat medium different from the refrigerant are connected by pipes, circulating the refrigerant, the refrigeration cycle device further including a circulating refrigerant composition detection circuit having a low-pressure side pressure detection device for detecting low-pressure side pressure corresponding to pressure of the refrigerant that is to be suctioned by the compressor, a high-low pressure bypass pipe connecting a pipe on a discharge side of the compressor and a pipe on a suction side of the compressor, a bypass expansion device disposed in the high-low pressure bypass pipe, a high-pressure side temperature detection device for detecting high-pressure side temperature corresponding to temperature of the refrigerant flowing into the bypass expansion device, a low-pressure side temperature detection device for detecting low-pressure side temperature corresponding to temperature of the refrigerant discharged from the bypass expansion device, and a heat exchanger related to refrigerant that exchanges heat between the refrigerant flowing into the bypass expansion device and the refrigerant discharged from the bypass expansion device;

a heat medium side device including a heat medium circuit in which a heat medium sending device for circulating the heat medium to be used for the heat exchange performed by the heat exchanger related to heat medium, a use side heat exchanger that exchanges heat between the heat medium and air in a space to be conditioned, and a heat medium flow switching device that switches to pass the heat medium having flowed through the heat exchanger related to heat medium toward the use side heat exchanger are connected by pipes;

a first controller that detects a circulation composition of the zeotropic refrigerant mixture in the refrigeration cycle device on the basis of at least the low-pressure side pressure, the high-pressure side temperature, and the low-pressure side temperature, and changes a driving frequency of the compressor based on, and in response to, a detected circulation composition data of the zeotropic refrigerant mixture that corresponds to the circulation composition of the zeotropic refrigerant mixture; and a second controller disposed at a position away from the first controller and connecting to be capable of communicating to the first controller with wire or no wire, the second controller performing, in a heat medium relay unit including the heat exchanger related to heat medium, at least one of a calculation of evaporating temperature of the heat exchanger related to heat medium that functions as an evaporator and degree of superheat on a refrigerant outlet side of the heat exchanger related to heat medium that functions as an evaporator and a calculation of condensing temperature of the heat exchanger related to heat medium that functions as a condenser and degree of subcooling on the refrigerant outlet side of the heat exchanger related to heat medium that functions as a condenser, on the basis of the circulation composition received through the communication with the first controller, wherein at least the compressor, the refrigerant flow switching device, the heat source side heat exchanger, and the circulating refrigerant composition detection circuit are accommodated in an outdoor unit, at least the heat exchanger related to heat medium and the refrigerant expansion device are accommodated in the heat medium relay unit, the outdoor unit and the heat medium relay unit are provided separately and are installable at separate positions to be away from each other, the first controller is provided in or near the outdoor unit; and the second controller is disposed in or near the heat medium relay unit, and the heat exchanger related to heat medium is one of a plurality of heat exchangers related to heat medium, including at least a first heat exchanger related to heat medium and a second heat exchanger related to heat medium;

the air-conditioning apparatus further comprising:

a first refrigerant temperature detection device, connected to an inlet end of the first heat exchanger related to heat medium, for detecting temperature on a refrigerant inlet side when the heat exchanger related to heat medium is functioning as a condenser;

a second refrigerant temperature detection device, different from the first temperature detection device, and connected to an outlet end of the second heat exchanger related to heat medium, for detecting temperature on the refrigerant outlet side when the heat exchanger related to heat medium is functioning as a condenser; and a first refrigerant pressure detection device connected to an outlet end of the first heat exchanger related to heat medium and to the first refrigerant temperature detection device, and disposed directly between the heat exchanger related to heat medium and the refrigerant flow switching device, for detecting pressure of the refrigerant flowing into the first heat exchanger related to heat medium; and a second refrigerant pressure detection device, different from the first refrigerant pressure detection device, and connected to an inlet end of the second heat exchanger related to heat medium, the inlet end of the second heat exchanger related to heat medium being opposite to the outlet end of the first heat exchanger related to heat medium to which the first refrigerant pressure detection device is connected, and to the second refrigerant temperature detection device, for detecting pressure of refrigerant discharged from the second heat exchanger related to heat medium when functioning as a condenser;

wherein the second controller is configured to determine the pressure of the refrigerant discharged and entered from at least one of the plurality of heat exchangers related to heat medium irrespective of a current operational mode, as the first refrigerant pressure detection device and the second refrigerant pressure detection device are located on opposite sides of their respective heat exchangers, calculate the degree of subcooling of the plurality of heat exchangers related to heat medium functioning as a condenser on the basis of the detected circulation composition data of the zeotropic refrigerant mixture, the pressure detected by the first refrigerant pressure detection device, and the temperature detected by the second-refrigerant temperature detection device, and calculate the degree of superheat of the plurality of heat exchangers related to heat medium functioning as an evaporator on the basis of the detected circulation composition data of the zeotropic refrigerant mixture, the pressure detected by the second refrigerant pressure detection device, and the temperature detected by the first-refrigerant temperature detection device.

8. The air-conditioning apparatus of claim 7, wherein the second controller calculates, on the basis of the circulation composition and the pressure detected by the first refrigerant pressure detection device, saturated liquid refrigerant temperature and saturated gas refrigerant temperature at the pressure detected by the first refrigerant pressure detection device, calculates the condensing temperature of the refrigerant on the basis of the saturated liquid refrigerant temperature and the saturated gas refrigerant temperature at the pressure detected by the first refrigerant pressure detection device, calculates, on the basis of the circulation composition and the pressure detected by the second refrigerant pressure detection device, saturated liquid refrigerant temperature and saturated gas refrigerant temperature at the pressure detected by the second refrigerant pressure detection device, calculates the evaporating temperature of the refrigerant on the basis of the saturated liquid refrigerant temperature and the saturated gas refrigerant temperature at the pressure detected by the first refrigerant pressure detection device, and then controls opening degree of the refrigerant expansion device.

9. The air-conditioning apparatus of claim 8, wherein mean temperature of the saturated liquid refrigerant temperature and the saturated gas refrigerant temperature is taken as the condensing temperature or the evaporating temperature.

10. The air-conditioning apparatus of claim 1, with a plurality of use side heat exchangers, having a heating only operation mode in which all of use side heat exchangers that are in operation perform a heating operation, a cooling only operation mode in which all of use side heat exchangers that are in operation perform a cooling operation, and a cooling and heating mixed operation mode in which part of the use side heat exchangers that are in operation perform the heating operation and other part of the remaining use side heat exchangers in operation perform the cooling operation, wherein, in the cooling and heating mixed operation mode, the apparatus is capable of flowing either the heat medium that has been heated or the heat medium that has been cooled, which is selected, through each of the use side heat exchangers by switching the heat medium flow switching device.

11. The air-conditioning apparatus of claim 1, wherein the first refrigerant pressure detection device is disposed between the heat exchanger related to heat medium and the refrigerant expansion device.

12. The air-conditioning apparatus of claim 1, wherein the first refrigerant pressure detection device is disposed between the heat exchanger related to heat medium and the refrigerant flow switching device.

13. The air-conditioning apparatus of claim 1, wherein the first refrigerant pressure detection device is disposed directly between the heat exchanger related to heat medium and the refrigerant expansion device.

14. The air-conditioning apparatus of claim 1, wherein the first refrigerant pressure detection device is directly adjacent to the heat exchanger related to heat medium.

15. A method, implemented in a controller, for detecting circulation composition of refrigerant in a refrigeration cycle device comprising:

setting an initial circulation composition of a refrigerant mixture containing tetrafluoropropene and R32 circulating in the refrigeration cycle device as an assumed circulation composition;

calculating an enthalpy of the refrigerant, irrespective of operational mode, as the refrigerant is circulated between an outlet side of a heat exchanger and an inlet side of a refrigerant expansion device based on at least one of a high-pressure side temperature, low-pressure side temperature, high-pressure side pressure, and low-pressure side pressure of the refrigeration cycle device including the refrigerant expansion device and the heat exchanger;

calculating a temperature of the refrigerant on an outlet side of the refrigerant expansion device based on, and in response to, the enthalpy of the refrigerant and the low-pressure side pressure as a calculated temperature;

adjusting the assumed circulation composition when the calculated temperature of the refrigerant is not equal to the low-pressure side temperature; and repeating the calculating of the enthalpy of the refrigerant on the inlet side of the refrigerant expansion device, the calculating of the temperature of the refrigerant on the outlet side of the refrigerant expansion device, and the adjusting of the assumed circulation composition until the calculated temperature of the refrigerant is equal to the low-pressure side temperature;

wherein the assumed circulation composition of the zeotropic refrigerant mixture includes an identity and a proportion of each of the components of the zeotropic refrigerant mixture.

16. The method according to claim 15, further comprising measuring the high-pressure side temperature, the low-pressure side pressure, the low-pressure side temperature, and the high-pressure side pressure of the refrigeration cycle device.

17. The air-conditioning apparatus of claim 1, wherein the circulation composition of the zeotropic refrigerant mixture includes an identity and a proportion of each of the components of the zeotropic refrigerant mixture, and the detected circulation composition data of the zeotropic refrigerant mixture includes the identity and the proportion of each of the components of the zeotropic refrigerant mixture.

18. The air-conditioning apparatus of claim 4, wherein the circulation composition of the zeotropic refrigerant mixture includes an identity and a proportion of each of the components of the zeotropic refrigerant mixture, and the detected circulation composition data of the zeotropic refrigerant mixture includes the identity and the proportion of each of the components of the zeotropic refrigerant mixture.

19. The air-conditioning apparatus of claim 7, wherein the circulation composition of the zeotropic refrigerant mixture includes an identity and a proportion of each of the components of the zeotropic refrigerant mixture, and the detected circulation composition data of the zeotropic refrigerant mixture includes the identity and the proportion of each of the components of the zeotropic refrigerant mixture.

* * * * *